US010646912B2

(12) United States Patent
Ishizuka et al.

(10) Patent No.: US 10,646,912 B2
(45) Date of Patent: May 12, 2020

(54) FORMING APPARATUS AND FORMING METHOD

(71) Applicant: SUMITOMO HEAVY INDUSTRIES, LTD., Tokyo (JP)

(72) Inventors: Masayuki Ishizuka, Niihama (JP); Norieda Ueno, Yokosuka (JP); Masayuki Saika, Niihama (JP); Takashi Komatsu, Oyama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 631 days.

(21) Appl. No.: 15/355,283

(22) Filed: Nov. 18, 2016

(65) Prior Publication Data

US 2017/0066028 A1 Mar. 9, 2017

Related U.S. Application Data

(63) Continuation of application No. PCT/JP2015/064479, filed on May 20, 2015.

(30) Foreign Application Priority Data

May 22, 2014 (JP) ..... 2014-105885

(51) Int. Cl.
*B21D 26/041* (2011.01)
*B21D 26/039* (2011.01)
(Continued)

(52) U.S. Cl.
CPC ..... *B21D 26/041* (2013.01); *B21D 26/039* (2013.01); *B21D 26/053* (2013.01);
(Continued)

(58) Field of Classification Search
CPC .. B21D 22/022; B21D 26/027; B21D 26/039; B21D 26/041; B21D 26/045;
(Continued)

(56) References Cited

U.S. PATENT DOCUMENTS 7,393,421 B2 * 7/2008 Yang ..... B21D 26/033 148/570
7,464,572 B2 * 12/2008 Miyanaga ..... B21D 26/033 29/421.1
(Continued)

FOREIGN PATENT DOCUMENTS

JP 2003-154415 A 5/2003
JP 2010-036208 A 2/2010
(Continued)

OTHER PUBLICATIONS

International Search Report dated Aug. 11, 2015 corresponding to International Patent Application No. PCT/JP2015/064479.
(Continued)

*Primary Examiner* — Edward T Tolan
(74) *Attorney, Agent, or Firm* — Squire Patton Boggs (US) LLP

(57) ABSTRACT

A forming apparatus that forms a metal pipe includes: a heating unit which heats a metal pipe material; a gas supply unit which supplies gas into a heated metal pipe material, thereby expanding the metal pipe material; a die which forms the metal pipe by bringing the expanded metal pipe material into contact with the die; a cooling unit which cools the metal pipe after the forming by a cooling medium; and a control unit which controls an operation of the die, the gas supply unit, and the cooling unit, wherein the control unit makes cooling of the metal pipe by the cooling medium be performed, by controlling an operation of the die such that the die is opened and controlling the cooling unit such that the cooling unit brings the cooling medium into contact with the metal pipe, subsequently to completion of forming by the die.

15 Claims, 16 Drawing Sheets

(51) Int. Cl.

| | |
|---|---|
| ***B21D 37/16*** | (2006.01) |
| ***B21D 26/053*** | (2011.01) |
| ***C21D 1/18*** | (2006.01) |
| ***C21D 9/08*** | (2006.01) |

(52) U.S. Cl.
CPC ..... *B21D 37/16* (2013.01); *C21D 1/18* (2013.01); *C21D 9/085* (2013.01); *C21D 2211/008* (2013.01)

(58) Field of Classification Search
CPC .... B21D 37/16; B21D 26/047; B21D 26/025; C21D 1/673; C21D 9/085
See application file for complete search history.

(56) References Cited

U.S. PATENT DOCUMENTS

2004/0040636 A1* 3/2004 Watanabe ..... B21D 26/041 148/570
2009/0126447 A1* 5/2009 Kondo ..... B21D 22/02 72/347
2009/0242086 A1* 10/2009 Thomas ..... C21D 1/673 148/654
2013/0160511 A1* 6/2013 Huang ..... B21D 26/021 72/60
2014/0090439 A1* 4/2014 Huang ..... B30B 1/16 72/352

FOREIGN PATENT DOCUMENTS

| | | | |
|---|---|---|---|
| JP | 2011-523593 | A | 8/2011 |
| JP | 2012-000654 | A | 1/2012 |
| JP | 2013-075329 | A | 4/2013 |
| JP | 2013-123722 | A | 6/2013 |
| WO | WO 2010/024530 | A2 | 3/2010 |

OTHER PUBLICATIONS

International Preliminary Report on Patentability International application No. PCT/JP2015/064479 dated Nov. 22, 2016.

* cited by examiner

FORMING APPARATUS AND FORMING METHOD

RELATED APPLICATIONS

Priority is claimed to Japanese Patent Application No. 2014-105885, filed May 22, 2014, and International Patent Application No. PCT/JP2015/064479, the entire content of each of which is incorporated herein by reference.

BACKGROUND

Technical Field

Certain embodiments of the present invention relate to a forming apparatus and a forming method which forma metal pipe.

Description of Related Art

In the related art, a forming apparatus is known which performs forming by expanding a heated metal pipe material by supplying gas into the heated metal pipe material. For example, a forming apparatus as disclosed in the related art is provided with an upper die and a lower die which are paired with each other, a holding unit which holds a metal pipe material between the upper die and the lower die, and a gas supply unit which supplies gas into the metal pipe material held by the holding unit. In this forming apparatus, it is possible to form the metal pipe material into a shape corresponding to the shape of a die by expanding the metal pipe material by supplying gas into the metal pipe material in a state of being held between the upper die and the lower die.

SUMMARY

According to an embodiment of the present invention, there is provided a forming apparatus that forms a metal pipe, including: a heating unit which heats a metal pipe material; a gas supply unit which supplies gas into a heated metal pipe material, thereby expanding the metal pipe material; a die which forms the metal pipe by bringing the expanded metal pipe material into contact with the die; a cooling unit which cools the metal pipe after the forming by a cooling medium; and a control unit which controls an operation of the die, the gas supply unit, and the cooling unit, in which the control unit makes cooling of the metal pipe by the cooling medium be performed, by controlling an operation of the die such that the die is opened and controlling the cooling unit such that the cooling unit brings the cooling medium into contact with the metal pipe, subsequently to completion of forming by the die.

According to another embodiment of the present invention, there is provided a forming method that forms a metal pipe, including: a heating step of heating a metal pipe material; a gas supply step of supplying gas into a heated metal pipe material, thereby expanding the metal pipe material; a forming step of forming the metal pipe by bringing the expanded metal pipe material into contact with a die; and a cooling step of cooling the metal pipe after the forming by a cooling medium, in which in the cooling step, cooling of the metal pipe by the cooling medium is performed by opening the die and bringing the cooling medium into contact with the metal pipe, subsequently to completion of the forming by the die.

BRIEF DESCRIPTION OF THE DRAWINGS

FIGS. 3A and 3B are diagrams showing a manufacturing process by the forming apparatus, in which FIG. 3A is a diagram showing a state where a metal pipe material has been set in a die and FIG. 3B is a diagram showing a state where the metal pipe material has been held by electrodes.

FIGS. 5A to 5C are enlarged views of the surroundings of the electrode, in which. FIG. 5A is a diagram showing a state where the electrode has held the metal pipe material, FIG. 5B is a diagram showing a state where a blowing mechanism is in contact with the electrode, and FIG. 5C is a front view of the electrode.

DETAILED DESCRIPTION

Figure 1:
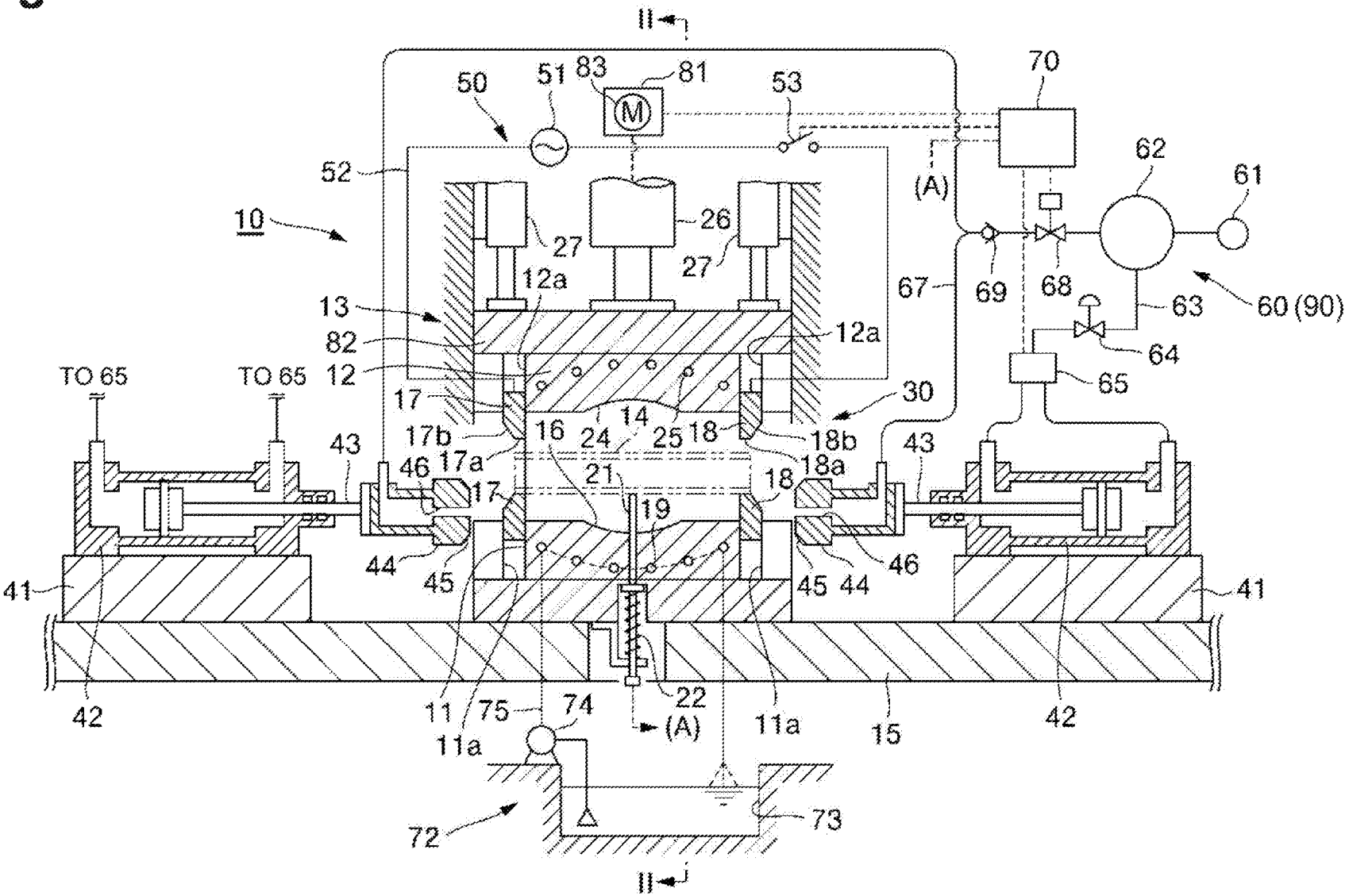
FIG. 1 is a schematic configuration diagram of a forming apparatus according to an embodiment of the present invention.

In the apparatus of the related art described above, after a metal pipe is formed by the die, quenching is performed by cooling the metal pipe by maintaining a state where the metal pipe is brought into contact with the die, for a predetermined time. However, in a case of performing only cooling by contact with the die, due to a cooling rate being too fast, the strength of the metal pipe is increased, and thus there is a case where the metal pipe becomes brittle (toughness is lowered). Therefore, it is required to obtain a forming product having suitable characteristics in accordance with a use of the forming product by controlling strength and toughness according to the use of the forming product.

It is desirable to provide a forming apparatus and a forming method, in which it is possible to obtain a forming product having suitable characteristics.

In the forming apparatus according to an embodiment of the present invention, the control unit makes cooling of the metal pipe by the cooling medium be performed, by controlling an operation of the die such that the die is opened and controlling the cooling unit such that the cooling unit brings the cooling medium into contact with the metal pipe, subsequently to completion of forming by the die. In this manner, by performing the cooling by the contact with the cooling medium, it is possible to slow down a cooling rate, compared to the cooling by the contact with the die, and thus quenching to enhance the toughness of the metal pipe becomes possible. Further, in a case of performing cooling by using the cooling medium, it is possible to easily perform adjustment of hardenability, compared to the cooling by contact with the die. By the above, it becomes possible to control the strength and the toughness of a forming product according to a use, and thus it is possible to obtain a forming product having suitable characteristics.

Further, in the forming apparatus according to an embodiment of the present invention, the control unit may make cooling of the metal pipe by the die be performed, by controlling an operation of the die such that a state where the die and the metal pipe are brought into contact with each other is maintained for a predetermined time, after the completion of the forming, and make cooling of the metal pipe by the cooling medium be performed, after the cooling of the metal pipe by the die. In this manner, by increasing a cooling rate by performing the cooling by the die after the completion of the forming, it is possible to shorten a time after the cooling is started and until the temperature of the metal pipe reaches a martensitic transformation start temperature. Therefore, it becomes possible to secure a longer martensite formation possible time, and thus it becomes possible to easily adjust the cooling rate by the cooling medium according to desired characteristics.

Further, in the forming apparatus according to an embodiment of the present invention, the control unit may make the cooling of the metal pipe by the die be performed until the metal pipe reaches a first temperature that is a temperature higher than a martensitic transformation start temperature. In this way, before the metal pipe reaches the first temperature which is a temperature before the martensitic transformation start temperature, it becomes possible to rapidly cool the metal pipe by the die.

Further, in the forming apparatus according to an embodiment of the present invention, the control unit may adjust hardenability of the metal pipe, based on a timing when the cooling of the metal pipe by the cooling medium is started. In this way, it is possible to easily adjust the hardenability of the metal pipe.

Further, in the forming apparatus according to an embodiment of the present invention, the cooling unit may blow gas for cooling as the cooling medium on the metal pipe. Due to using gas as the cooling medium, flow rate adjustment or the like is easy, and therefore, it is possible to easily perform adjustment of hardenability. Further, it is possible to cool the metal pipe without contaminating it.

Further, in the forming apparatus according to an embodiment of the present invention, the cooling unit may be configured of the gas supply unit. In this way, the gas supply unit for expanding the metal pipe can be diverted as the cooling unit, and therefore, it is possible to make the forming apparatus compact.

Further, in the forming apparatus according to an embodiment of the present invention, the cooling unit may blow the gas for cooling on both the inner surface and the outer surface of the metal pipe. In this way, it becomes possible to remove oxide layers stuck to both the inner surface and the outer surface of the metal pipe, and thus it becomes possible to effectively improve the quality of a forming product.

According to the forming method according to another embodiment of the present invention, it is possible to obtain the same operation and effects as those of the forming apparatus described above.

Further, in the forming method according to another embodiment of the present invention, in the cooling step, cooling of the metal pipe by the die may be performed by controlling an operation of the die such that a state where the die and the metal pipe are brought into contact with each other is maintained for a predetermined time, after the completion of the forming, and cooling of the metal pipe by the cooling medium may be performed after the cooling of the metal pipe by the die. In this manner, by increasing a cooling rate by performing the cooling by the die after the completion of the forming, it is possible to shorten a time after the cooling is started and until the temperature of the metal pipe reaches a martensitic transformation start temperature. Therefore, it becomes possible to secure a longer martensite formation possible time, and thus it becomes possible to easily adjust the cooling rate by the cooling medium according to desired characteristics.

Further, in the forming method according to another embodiment of the present invention, in the cooling step, the cooling of the metal pipe by the die may be performed until the metal pipe reaches a first temperature that is a temperature higher than a martensitic transformation start temperature. In this way, before the metal pipe reaches the first temperature which is a temperature before the martensitic transformation start temperature, it becomes possible to rapidly cool the metal pipe by the die.

Further, in the forming method according to another embodiment of the present invention, in the cooling step, hardenability of the metal pipe may be adjusted based on a timing when the cooling of the metal pipe by the cooling medium is started. In this way, it is possible to easily adjust the hardenability of the metal pipe.

Further, in the forming method according to another embodiment of the present invention, in the cooling step, cooling of the metal pipe may be performed by blowing gas for cooling as the cooling medium on the metal pipe. Due to using gas as the cooling medium, flow rate adjustment or the like is easy, and therefore, it is possible to easily perform adjustment of hardenability. Further, it is possible to cool the metal pipe without contaminating it.

Further, in the forming method according to another embodiment of the present invention, in the cooling step, the gas may be blown on both the inner surface and the outer surface of the metal pipe. In this way, the metal pipe is uniformly cooled, and thus occurrence of unevenness in the hardenability of the metal pipe can be suppressed. In addition, it becomes possible to remove oxide layers stuck to both the inner surface and the outer surface of the metal pipe, and thus it becomes possible to effectively improve the quality of a forming product.

Further, in the forming method according to another embodiment of the present invention, in the cooling step, oxide layers stuck to the surface of the metal pipe may be removed by blowing the gas on the metal pipe. In this way, the oxide layers stuck to the surface of the metal pipe are removed, and thus it is possible to prevent the oxide layer from remaining on the surface of a forming product. For this reason, the influence on the external appearance and material strength of a forming product can be suppressed, and thus it becomes possible to improve the quality of the forming product.

<Configuration of Forming Apparatus>

As shown in FIG. 1, a forming apparatus 10 which forms a metal pipe is configured to include: a blow forming die (a die) 13 which is composed of an upper die 12 and a lower die 11; a slide 82 which moves at least one of the upper die 12 and the lower die 11; a drive unit 81 which generates a driving force for moving the slide 82; a pipe holding mechanism 30 which horizontally holds a metal pipe material 14 between the upper die 12 and the lower die 11; a heating mechanism (a heating unit) 50 which energizes and heats the metal pipe material. 14 held by the pipe holding mechanism 30; a blowing mechanism (a gas supply unit) 60 which blows high-pressure gas into the heated metal pipe material 14; a control unit 70 which controls the drive unit 81, the pipe holding mechanism 30, the operation of the blow forming die 13, the heating mechanism 50, and the blowing mechanism 60; a water circulation mechanism 72 which forcibly water-cools the blow forming die 13; and a cooling unit 90 which cools the metal pipe 80 by a cooling medium. The control unit 70 performs a series of control such as closing the blow forming die 13 when the metal pipe material 14 has been heated to a quenching temperature (a temperature higher than or equal to an AC3 transformation point temperature) and blowing high-pressure gas into the heated metal pipe material 14. In the following description, a pipe after forming is referred to as a metal pipe 80 (refer to FIG. 2B), and a pipe in a stage on the way to lead to completion is referred to as the metal pipe material 14.

Figure 5A:
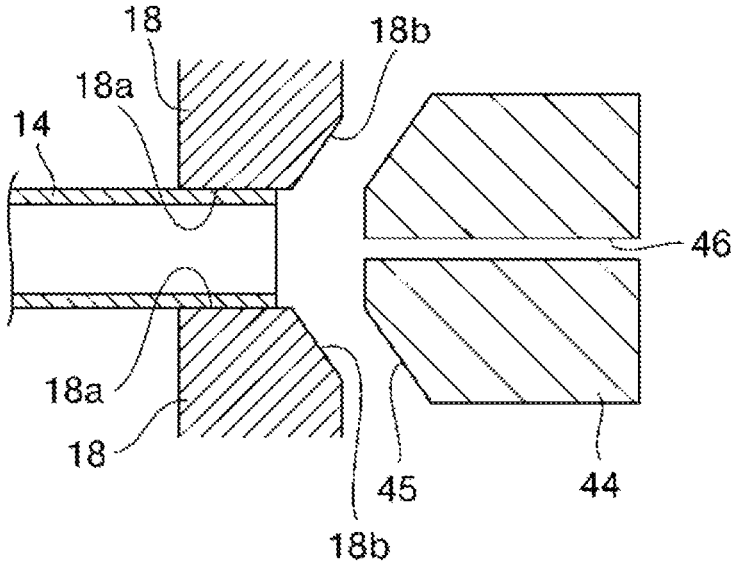
Figure 5B:
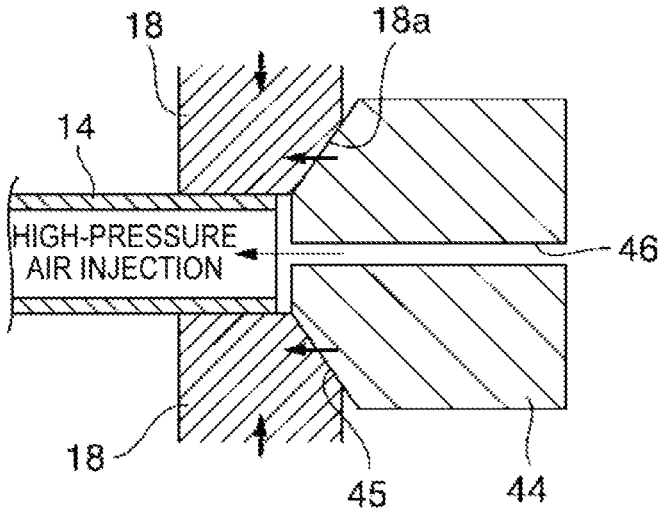
Figure 5C:
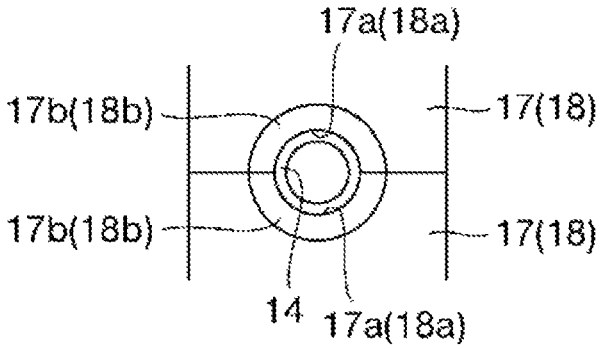

The lower die 11 is fixed to a large base 15. Further, the lower die 11 is configured of a large steel block and has a cavity (a recessed portion) 16 formed in the upper surface thereof. Further, electrode storage spaces 11*a* are provided in the vicinity of right and left ends (right and left ends in FIG. 1) of the lower die 11, and a first electrode 17 and a second electrode 18 configured so as to be able to be advanced and retreated up and down by an actuator (not shown) are provided in the spaces 11*a*. Semicircular arc-shaped concave grooves 17*a* and 18*a* corresponding to the lower-side outer peripheral surface of the metal pipe material 14 are formed in the upper surfaces of the first and second electrodes 17 and 18 (refer to FIG. 5C), and the metal pipe material 14 can be placed so as to be exactly fitted to the portions of the concave grooves 17*a* and 18*a*. Further, tapered concave surfaces 17*b* and 18*b* recessed to be inclined in a tapered shape in circumference toward the concave grooves 17*a* and 18*a* are formed in the front faces (the faces in an outward direction of a die) of the first and second electrodes 17 and 18. Further, a cooling water passage 19 is formed in the lower die 11, and a thermocouple 21 inserted from below is provided approximately at the center of the lower die 11. The thermocouple 21 is supported by a spring 22 so as to be able to move up and down.

Further, a pair of first and second electrodes 17 and 18 which is located on the lower die 11 side also serves as the pipe holding mechanism 30 and can horizontally support the metal pipe material 14 such that the metal pipe material 14 can move up and down between the upper die 12 and the lower die 11. Further, the thermocouple 21 merely illustrates an example of temperature measuring means, and a non-contact type temperature sensor such as a radiation thermometer or an optical thermometer is also acceptable. If the correlation between an energization time and a temperature is obtained, it is also sufficiently possible to make a configuration with the temperature measuring means omitted.

The upper die 12 is a large steel block having a cavity (a recessed portion) 24 in the lower surface thereof and having a cooling water passage 25 formed therein. The upper die 12 is fixed to the slide 82 at an upper end portion thereof. Then, the slide 82 with the upper die 12 fixed thereto is suspended from a pressurizing cylinder 26 and guided by a guide cylinder 27 so as not to laterally oscillate. The drive unit 81 according to this embodiment is provided with a servomotor 83 which generates a driving force for moving the slide 82. The drive unit 81 is configured by a fluid supply section which supplies a fluid that drives the pressurizing cylinder 26 (hydraulic oil in a case where a hydraulic cylinder is adopted as the pressurizing cylinder 26) to the pressurizing cylinder 26. The control unit 70 can control the movement of the slide 82 by controlling the amount of the fluid which is supplied to the pressurizing cylinder 26, by controlling the servomotor 83 of the drive unit 81. Further, the drive unit 81 is not limited to a configuration to apply a driving force to the slide 82 through the pressurizing cylinder 26, as described above, and may have, for example, a configuration to directly or indirectly apply a driving force that is generated by the servomotor 83 to the slide 82 by mechanically connecting the drive unit to the slide 82. Further, in this embodiment, only the upper die 12 moves. However, a configuration is also acceptable in which in addition to the upper die 12 or instead of the upper die 12, the lower die 11 moves. Further, in this embodiment, the drive unit 81 may not be provided with the servomotor 83.

Further, the first electrode 17 and the second electrode 18 configured so as to be able to be advanced and retreated up and down by an actuator (not shown) are provided in electrode storage spaces 12*a* provided in the vicinity of right and left ends (right and left ends in FIG. 1) of the upper die 12, similar to the lower die 11. The semicircular arc-shaped concave grooves 17*a* and 18*a* corresponding to the upper-side outer circumferential surface of the metal pipe material 14 are formed in the lower surfaces of the first and second electrodes 17 and 18 (refer to FIG. 5C), and the metal pipe material 14 can be exactly fitted to the concave grooves 17*a* and 18*a*. Further, the tapered concave surfaces 17*b* and 18*b* recessed to be inclined in a tapered shape in circumference toward the concave grooves 17*a* and 18*a* are formed in the front faces (the faces in the outward direction of the die) of the first and second electrodes 17 and 18. That is, a configuration is made such that, if the metal pipe material 14 is gripped by the upper and lower pairs of first and second electrodes 17 and 18 from an up-and-down direction, the outer circumference of the metal pipe material 14 can be exactly surrounded in a close contact manner over the entire circumference.

Figure 2A:
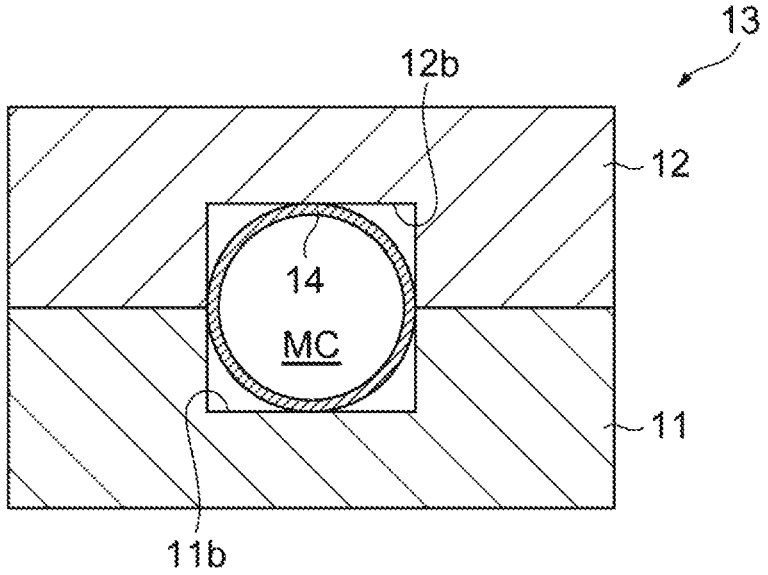
FIGS. 2A and 2B are cross-sectional views taken along line II-II shown in FIG. 1 and are schematic cross-sectional views of a blow forming die.
Figure 2B:
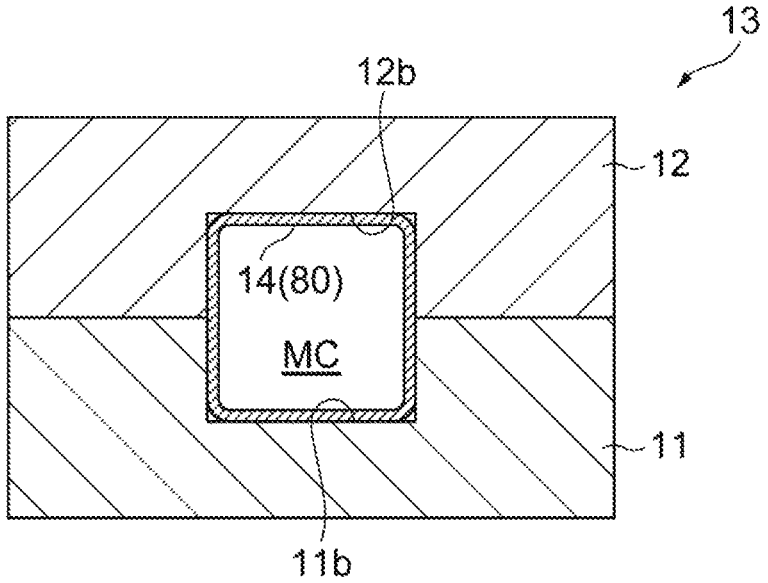

FIGS. 2A and 2B are schematic cross-sectional views when the blow forming die 13 is viewed from a side direction. These are cross-sectional views of the blow forming die 13 taken along line II-II in FIG. 1 and show the state of a die position at the time of blow forming. As shown in FIGS. 2A and 2B, a rectangular recessed portion 11*b* is formed in the upper surface of the lower die 11. In the lower surface of the upper die 12, a rectangular recessed portion 12*b* is formed at a position facing the recessed portion 11*b* of the lower die 11. In a state where the blow forming die 13 has been closed, the recessed portion 11*b* of the lower die 11 and the recessed portion 12*b* of the upper die 12 are combined, whereby a main cavity portion MC that is a rectangular space is formed. The metal pipe material 14 disposed in the main cavity portion MC, as shown in FIG. 2A, expands, thereby coming into contact with the inner wall surfaces of the main cavity portion MC and being formed into the shape (here, a rectangular cross-sectional shape) of the main cavity portion MC, as shown in FIG. 2B.

The heating mechanism 50 is configured to have a power supply 51, a conducting wire 52 which extends from the power supply 51 and is connected to the first electrode 17 and the second electrode 18, and a switch 53 interposed in the conducting wire 52.

The blowing mechanism 60 is composed of a high-pressure gas source 61, an accumulator 62 which stores high-pressure gas supplied from the high-pressure gas source 61, a first tube 63 which extends from the accumulator 62 to a cylinder unit 42, a pressure control valve 64 and a changeover valve 65 which are interposed in the first tube 63, a second tube 67 which extends from the accumulator 62 to a gas passage 46 formed in a seal member 44, and an ON-OFF valve 68 and a check valve 69 which are interposed in the second tube 67. Further, a leading end of the seal member 44 has a tapered surface 45 formed therein such that the leading end is tapered. The tapered surface 45 is configured in a shape capable of being exactly fitted to and brought into contact with the tapered concave surfaces 17*b* and 18*b* of the first and second electrodes (refer to FIGS. 5A to 5C). Further, the seal member 44 is connected to the cylinder unit 42 through a cylinder rod 43, thereby being made so as to be able to advance and retreat in accordance with the operation of the cylinder unit 42. Further, the cylinder unit 42 is placed on and fixed to the base 15 through a block 41.

The pressure control valve 64 plays a role to supply high-pressure gas having an operating pressure adapted to be a pushing force which is required from the seal member 44 side, to the cylinder unit 42. The check valve 69 plays a role to prevent the high-pressure gas from flowing back in the second tube 67. The control unit 70 obtains temperature information from the thermocouple 21 through transmission of information from (A) to (A) and controls the pressurizing cylinder 26, the switch 53, the changeover valve 65, the ON-OFF valve 68, and the like.

The water circulation mechanism 72 is composed of a water tank 73 which stores water, a water pump 74 which pumps up and pressurizes the water stored in the water tank 73 and sends the water to the cooling water passage 19 of the lower die 11 and the cooling water passage 25 of the upper die 12, and a pipe 75. Although it is omitted, a cooling tower which lowers a water temperature or a filter which purifies water may be interposed in the pipe 75.

<Operation of Forming Apparatus>

Figure 3A:
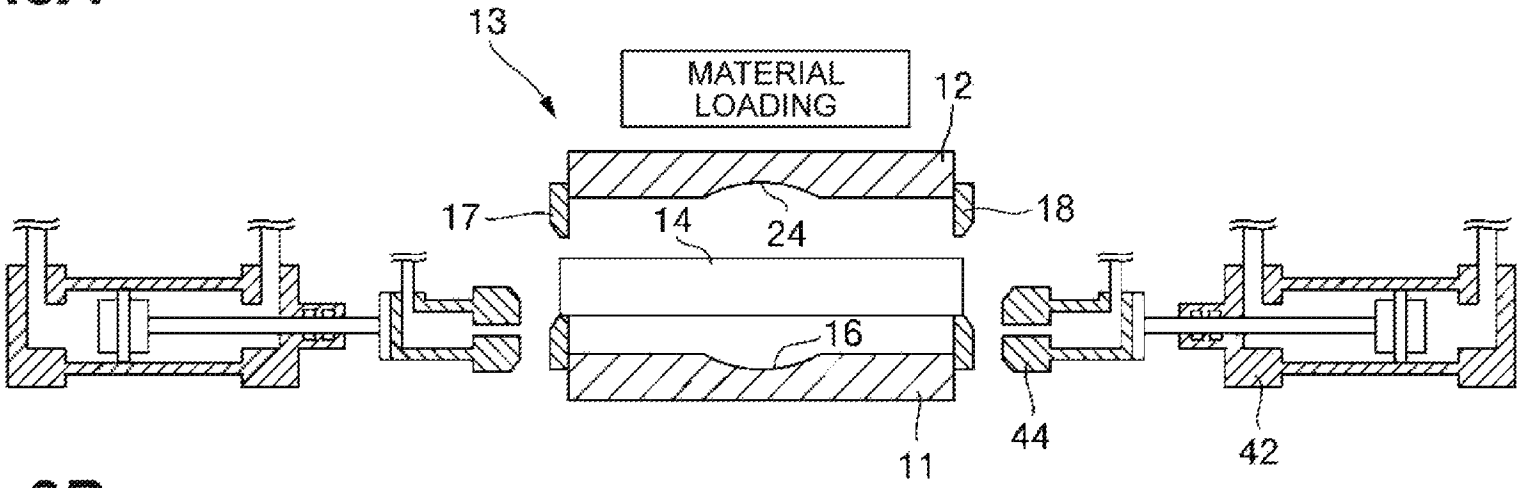
Figure 3B:
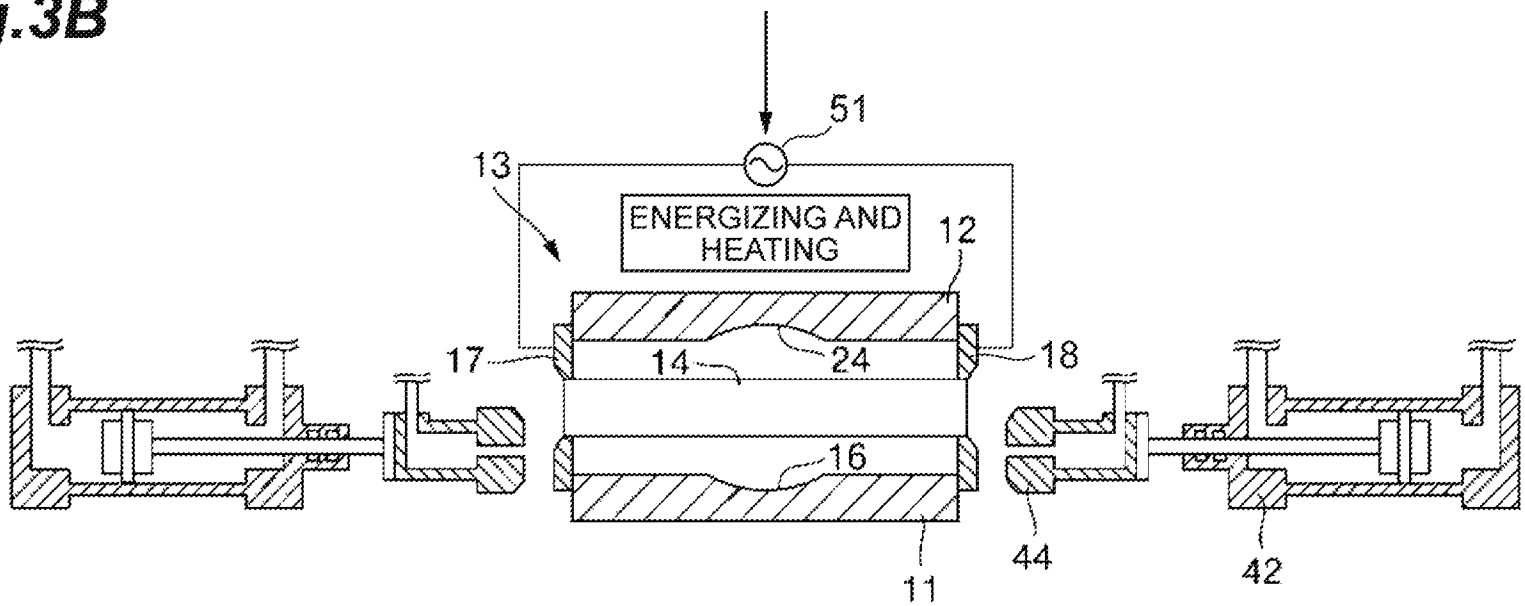

Next, an operation of the forming apparatus 10 will be described. FIGS. 3A and 3B show a manufacturing process from a pipe loading process of loading the metal pipe material 14 as a material to an energizing and heating process of energizing and heating the metal pipe material 14. As shown in FIG. 3A, the metal pipe material 14 having a steel grade capable of being quenched is prepared and the metal pipe material 14 is placed on the first and second electrodes 17 and 18 provided on the lower die 11 side by using a robot arm (not shown) or the like. The concave grooves 17*a* and 18*a* are formed in the first and second electrodes 17 and 18, and therefore, the metal pipe material 14 is positioned by the concave grooves 17*a* and 18*a*. Next, the control unit 70 (refer to FIG. 1) controls the pipe holding mechanism 30 such that the pipe holding mechanism 30 holds the metal pipe material 14. Specifically, as in FIG. 3B, an actuator (not shown) capable of advancing and retreating the respective electrodes 17 and 18 is operated, thereby making the first and second electrodes 17 and 18 which are located on each of the upper and lower sides approach each other and come into contact with each other. Due to this contact, both end portions of the metal pipe material 14 are gripped by the first and second electrodes 17 and 18 from above and below. Further, this gripping, the metal pipe material 14 is gripped in a close contact aspect over the entire circumference thereof due to the existence of the concave grooves 17*a* and 18*a* formed in the first and second electrodes 17 and 18. However, there is no limitation to the configuration in which close contact is performed over the entire circumference of the metal pipe material 14, and a configuration is also acceptable in which the first and second electrodes 17 and 18 come into contact with a portion in a peripheral direction of the metal pipe material 14.

Subsequently, the control unit 70 controls the heating mechanism 50 such that the heating mechanism 50 heats the metal pipe material 14. Specifically, the control unit 70 switches on the switch 53 of the heating mechanism 50. Then, electric power is supplied from the power supply 51 to the metal pipe material 14, and the metal pipe material 14 itself generates heat (Joule heat) due to resistance which is present in the metal pipe material 14. In this case, the measurement value of the thermocouple 21 is continuously monitored and energization is controlled based on the result.

Figure 4:
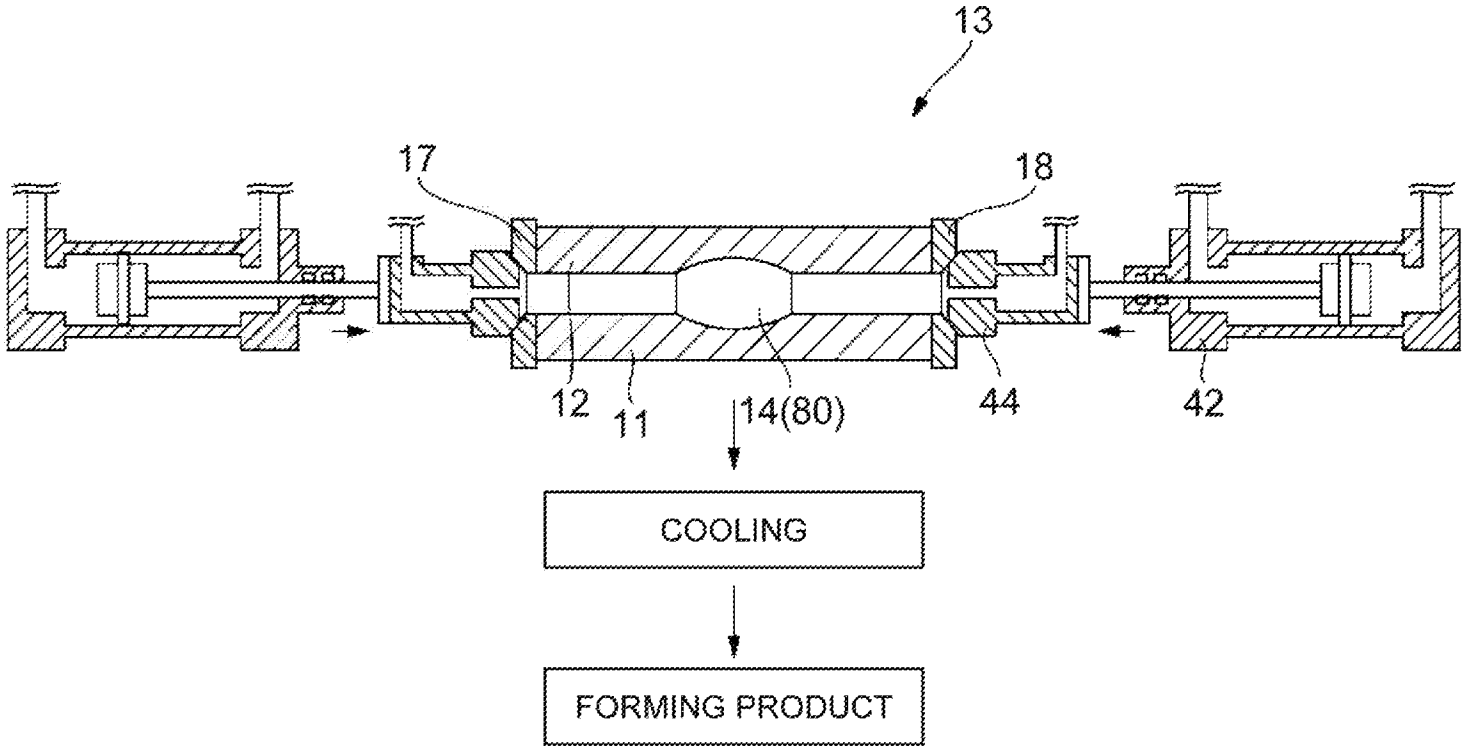
FIG. 4 is a diagram showing a blow forming process by the forming apparatus and the subsequent flow.

FIG. 4 shows blow forming and the processing content after the blow forming. Specifically, as shown in FIG. 4, the blow forming die 13 is closed with respect to the metal pipe material 14 after the heating, and thus the metal pipe material 14 is disposed and hermetically sealed in the cavity of the blow forming die 13. Thereafter, the cylinder units 42 are operated, thereby sealing both ends of the metal pipe material 14 by the seal members 44, each of which is a portion of the blowing mechanism 60 (also refer to FIGS. 5A to 5C together). The sealing is indirectly performed through the tapered concave surfaces 17*b* and 18*b* formed in the first and second electrodes 17 and 18, rather than being performed by direct contact of the seal members 44 with both end faces of the metal pipe material 14. By doing so, the sealing can be performed at the wide area, and therefore, seal performance can be improved. In addition, wear of the seal member due to a repeated sealing operation is prevented and collapse or the like of both end faces of the metal pipe material 14 is effectively prevented. After the completion of the sealing, high-pressure gas is blown into the metal pipe material 14, whereby the metal pipe material 14 softened due to heating is deformed so as to conform to the shape of the cavity. Thereafter, if cooling is performed on the metal pipe material 14 after the blow forming and thus quenching is performed, the metal pipe 80 is completed (the details will be described later).

The metal pipe material 14 is softened by being heated to a high temperature (around 950° C.), and thus the metal pipe material 14 can be blow-formed with relatively low pressure. Specifically, in a case where compressed air having a normal temperature (25° C.) at a pressure of 4 MPa is adopted as the high-pressure gas, as a result, the compressed air is heated to around 950° C. in the hermetically-sealed metal pipe material 14. The compressed air thermally expands and reaches a pressure in a range of about 16 MPa to 17 MPa, based on the Boyle-Charles' Law. That is, it is possible to easily blow-form the metal pipe material 14 having a temperature of 950° C.

Then, the outer peripheral surface of the blow-formed and swelled metal pipe material 14 is rapidly cooled in contact with the cavity 16 of the lower die 11 and at the same time, is rapidly cooled in contact with the cavity 24 of the upper die 12 (since each of the upper die 12 and the lower die 11 has a large heat capacity and is managed to have a low temperature, if the metal pipe material 14 comes into contact therewith, the heat of the surface of the pipe is removed to the die side at once). Such a cooling method is called die contact cooling or die cooling. Thereafter, quenching of the metal pipe 80 is performed by supplying a cooling medium to the metal pipe 80.

(Cooling of Metal Pipe)

Next, cooling of the metal pipe 80 after the forming will be described. The forming apparatus 10 according to this embodiment is provided with the cooling unit 90 which supplies a cooling medium to the metal pipe 80 after the forming, in forming apparatus 10 according to this embodiment, the control unit 70 makes the cooling of the metal pipe 80 by the cooling medium be performed, by controlling the operation of the blow forming die 13 such that the blow forming die 13 is opened and controlling the cooling unit 90 such that the cooling unit 90 brings the cooling medium into contact with the metal pipe 80, after the completion of the forming by the blow forming die 13. The cooling medium is not particularly limited, and gas such as air or inert gas may be applied, liquid such as water or oil may be applied, and solid such as a metal plate or dry ice may be applied. Further, among these cooling mediums, plural types of cooling medium may be used in combination. In the example shown in FIG. 1, the cooling unit 90 is configured of the blowing mechanism 60. That is, the cooling unit 90 blows gas for cooling (the gas used in the air blowing for forming may be diverted) as the cooling medium on the metal pipe 80, thereby cooling the metal pipe 80.

The control unit 70 makes the cooling of the metal pipe 80 by the cooling medium be performed, by controlling the operation of the blow forming die 13 such that the blow forming die 13 is opened and controlling the cooling unit 90 such that the cooling unit 90 brings the cooling medium into contact with the metal pipe 80, subsequently to the completion of the forming by the blow forming die 13. Further, the control unit 70 controls the operation of the blow forming die 13 by moving the upper die 12 through the slide 82 by controlling the drive unit 81. Further, the control unit 70 may make the cooling of the metal pipe 80 by the blow forming die 13 be performed, by controlling the operation of the blow forming die 13 such that a state where the blow forming die 13 and the metal pipe 80 are brought into contact with each other is maintained for a predetermined time, after the completion of the forming, and then make the cooling of the metal pipe 80 by the cooling medium be performed. Further, the control unit 70 may make the cooling of the metal pipe 80 by the blow forming die 13 be performed until the metal pipe 80 reaches a first temperature (a temperature T1 of FIG. 7B (described later)) which is a temperature higher than a martensitic transformation start temperature. Further, the control unit 70 may adjust the hardenability of the metal pipe 80, based on a timing when the cooling of the metal pipe 80 by the cooling medium is started.

Figure 7A:
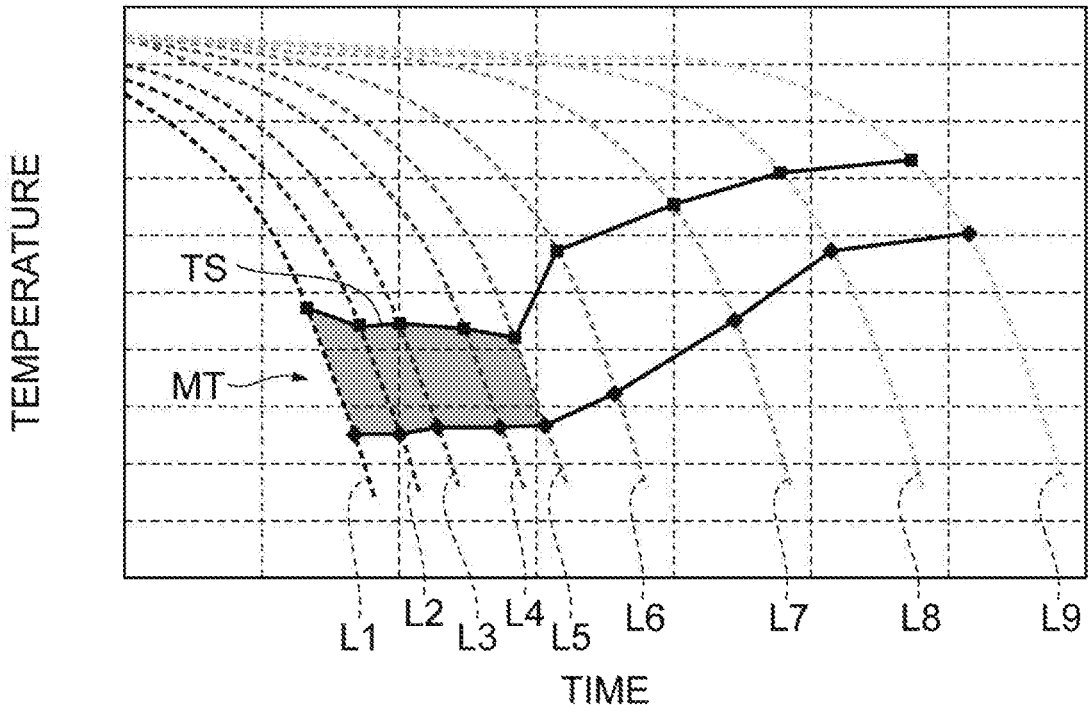
FIGS. 7A and 7B are graphs showing the relationship between a time and a temperature at the time of the quenching.
Figure 7B:
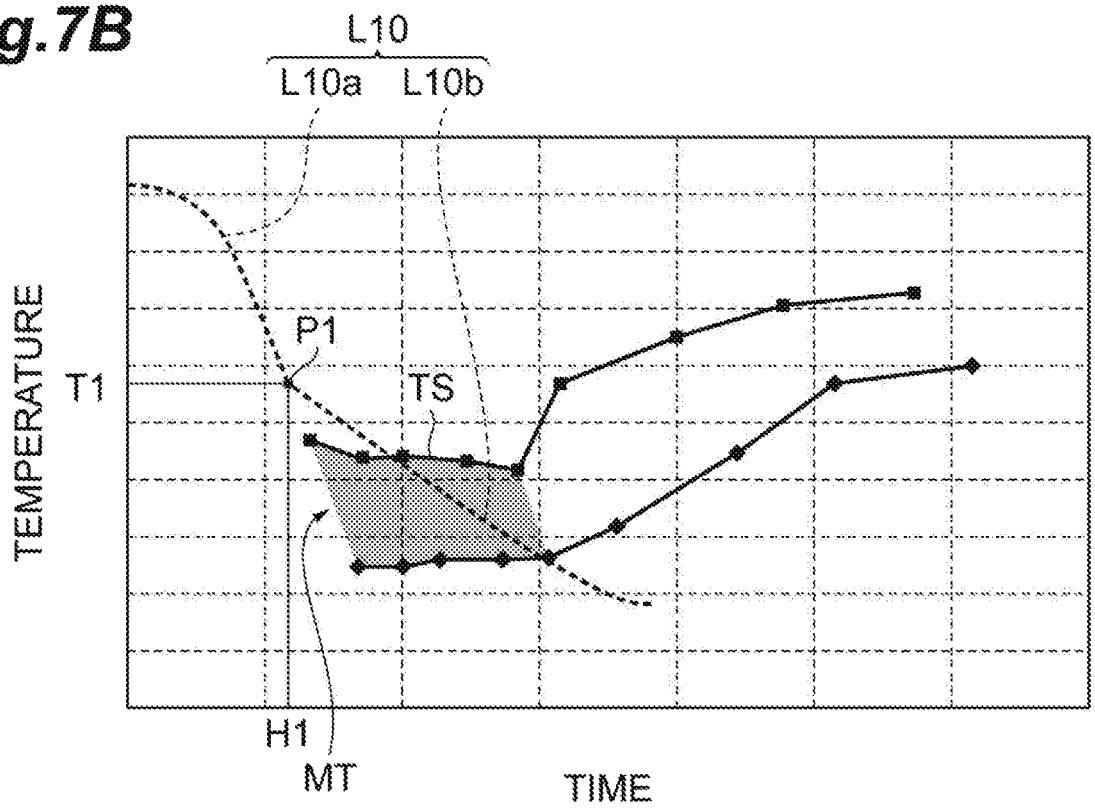

The relationship between the cooling of the metal pipe 80 and a temperature in this embodiment will be described with reference to the graphs of FIGS. 7A and 7B. First, the relationship between the strength of the metal pipe 80 and the cooling will be described with reference to FIG. 7A. In the drawing, an area with a gray scale applied thereto indicates a martensitic transformation area MT. In the drawing, a dashed line is a graph showing a change in time and temperature when cooling the metal pipe 80. The cooling rate of the metal pipe 80 becomes faster in the order of a dashed line L9, a dashed line L8, a dashed line L7, a dashed line L6, a dashed line L5, a dashed line L4, a dashed line L3, a dashed line L2, and a dashed line L1. If a dashed line passes through the martensitic transformation area MT, martensitic transformation occurs. The strength of the metal pipe 80 changes according to a cooling rate in an area lower than or equal to a martensitic transformation start temperature TS. Here, the martensitic transformation start temperature TS is the maximum temperature in the martensitic transformation area MT. The martensitic transformation start temperature TS in this embodiment is equivalent to an upper polygonal line which is in contact with the martensitic transformation area MT in FIGS. 7A and 7B. In the metal pipe 80, the more the cooling occurring along the dashed line which is located on the left side of the drawing, the more the hardness increases. Further, in the metal pipe 80, the more the cooling occurring along the dashed line which is located on the right side of the drawing, the more the hardness decreases. However, toughness increases. For example, a dashed line indicating a temperature change in a case where only the cooling by bringing the blow forming die 13 and the metal pipe 80 into contact with each other is performed after the end of the forming is set to be L1. In contrast, in a case where die opening is performed immediately after the completion of the forming and the cooling unit 90 brings the cooling medium into contact with the metal pipe 80, by performing cooling such that a temperature change along each of the dashed lines L2 to L5 occurs, it is possible to obtain the metal pipe 80 having high toughness. However, in a case of cooling the metal pipe 80 such that a temperature change along each of the dashed lines L6 to L9 occurs, since the dashed lines L6 to L9 do not pass through the martensitic transformation start temperature TS, the dashed lines L6 to L9 do not pass through the martensitic transformation area MT as well. Accordingly, as will be described later, it is preferable to perform cooling with die cooling appropriately combined therewith.

Further, the control unit 70 may make the cooling of the metal pipe 80 by the blow forming die 13 be performed, by controlling the operation of the blow forming die such that a state where the blow forming die 13 and the metal pipe 80 are brought into contact with each other is maintained for a predetermined time, after the completion of the forming, and then make the cooling of the metal pipe 80 by the cooling medium be performed, by controlling the cooling unit 90. The control unit 70 makes the cooling of the metal pipe 80 by the blow forming die 13 be performed until the metal pipe 80 reaches the first temperature (the temperature T1 in FIG. 7B) which is a temperature higher than the martensitic transformation start temperature TS. Specifically, as shown in FIG. 7B, the control unit 70 controls the operation of the blow forming die 13 and the cooling unit 90 such that the metal pipe 80 is cooled so as to have a temperature change along a dashed line L10. The control unit 70 performs control such that a state where the blow forming die 13 is brought into contact with the metal pipe 80 is maintained, immediately after the completion of the forming. Further, the control unit 70 starts the cooling of the metal pipe 80 by the cooling medium by releasing the contact between the blow forming die 13 and the metal pipe 80 by performing the die opening of the blow forming die 13 at a starting point P1, and controlling the cooling unit 90. The starting point P1 is a point at which switching from the cooling by blow forming die 13 to the cooling by a cooling catalyst is performed, and a temperature at the starting point P1 is set to be T1 and a time at the starting point P1 (an elapsed time from the start of cooling) is set to be H1. In this case, the time H1 corresponds to a time to maintain a state where the metal pipe 80 is brought into contact with the blow forming die 13. During the period until the time H1 elapses from the completion of the forming, the temperature of the metal pipe 80 rapidly decreases along a dashed line L10*a* due to conductive heat transfer from the metal pipe 80 to the blow forming die 13. After the lapse of the time H1, the cooling by the cooling medium is performed. In this case, due to conductive heat transfer from the metal pipe 80 to the cooling medium, the temperature of the metal pipe 80 follows a dashed line L10*b* and cooling is performed at a lower cooling rate in comparison with the dashed line L10*a*. The temperature T1 at the starting point P1 is a temperature higher than the martensitic transformation start temperature TS. Further, the control unit 70 may start the cooling by the cooling unit 90, based on the lapse of the time H1 from the start of cooling, and may start the cooling by the cooling unit 90 at a timing when arrival of the temperature of the metal pipe 80 at the temperature T1 has been detected.

The control unit 70 adjusts the hardenability of the metal pipe 80, based on a timing (the starting point P1) when the cooling of the metal pipe 80 by the cooling medium is started. That is, the control unit 70 adjusts the starting point P1 so as to extend a quenching time by the cooling medium, whereby it is possible to improve stretchability, although strength is reduced. Alternatively, the control unit 70 shortens the quenching time by the cooling medium, whereby it is possible to improve strength. The control unit 70 makes cooling be performed on a preset cooling condition, based on characteristics which are required in accordance with a use or the like of the metal pipe 80 that is a forming target.

Next, an example of a process of the cooling (quenching) of the metal pipe 80 after the completion of the forming will be described with reference to FIGS. 6A to 6C. In the forming apparatus 10 shown in FIGS. 6A to 6C, the blowing mechanism 60 is used as the cooling unit 90 which blows a cooling medium CM on the metal pipe 80. Further, in the example shown in FIGS. 6A to 6C, the control unit 70 controls the operation of the blow forming die 13 such that a state where the blow forming die 13 and the metal pipe 80 are brought into contact with each other is maintained for a predetermined time, after the completion of the forming. In this way, the cooling of the metal pipe 80 by the blow forming die 13 is performed, and the cooling of the metal pipe 80 by the cooling medium CM is performed after the cooling of the metal pipe 80 by the blow forming die 13.

Figure 6A:
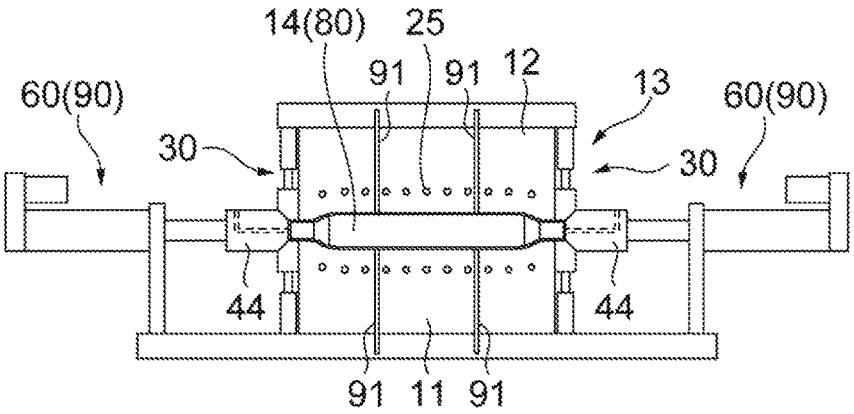
FIGS. 6A to 6C are diagrams showing a state when quenching by the forming apparatus is performed.

First, as shown in FIG. 6A, immediately after the completion of the forming by the blow forming die 13, the control unit 70 controls the operation of the blow forming die 13 such that a state where the upper die 12 and the lower die 11 are closed is maintained and a state where the blow forming die 13 and the metal pipe 80 are brought into contact with each other is maintained for a predetermined time. Further, the control unit 70 controls the operation of the water circulation mechanism 72 so as to make cooling water flow through the cooling water passage 25. In this way, the conductive heat transfer from the metal pipe 80 to the blow forming die 13 is performed, and thus the cooling of the metal pipe 80 by the blow forming die 13 is performed.

Figure 6B:
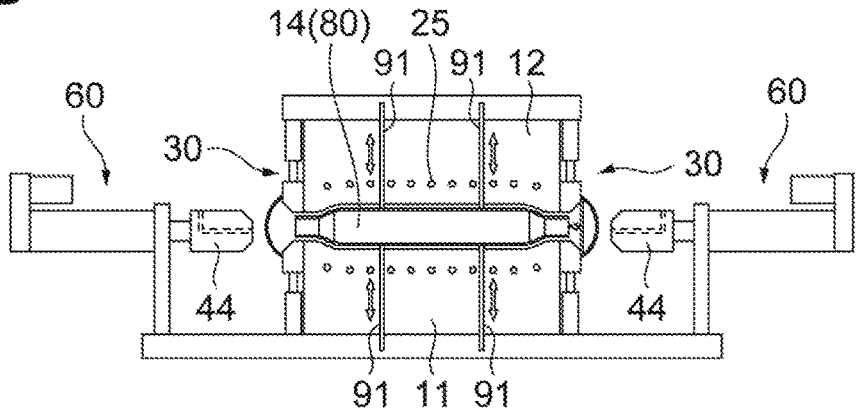
Figure 6C:
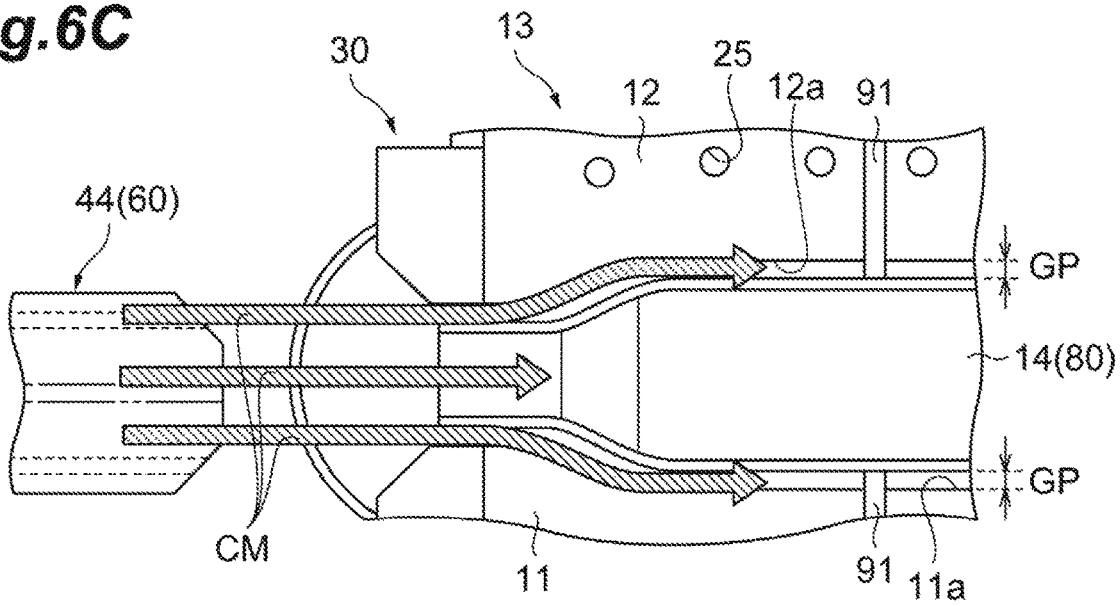

Next, as shown in FIG. 6B, the control unit 70 performs control of the operation of the blow forming die 13 such that the blow forming die 13 is opened, after the cooling of the metal pipe 80 by the blow forming die 13. Further, the control unit 70 controls the blowing mechanism 60 such that the seal members 44 are separated from both end portions of the metal pipe 80. In this case, the control unit 70 performs control to open the blow forming die 13 such that a gap GP is formed between the surface of the recessed portion 11*b* of the lower die 11 and the outer surface of the metal pipe 80 and a gap GP is formed between the surface of the recessed portion 12*b* of the upper die 12 and the outer surface of the metal pipe 80, as shown in FIG. 6C. Further, the control unit 70 controls a pin 91 of an ejector such that the metal pipe 80 is held in the opened blow forming die 13 in a state where the gap GP is provided between the surface of the blow forming die 13 and the outer surface of the metal pipe. In this state, the control unit 70 controls the blowing mechanism 60 such that the blowing mechanism 60 blows high-pressure gas as the cooling medium CM toward the end portion of the metal pipe 80 from the leading end of the seal member 44. In this case, the cooling medium CM flows into the inside of the metal pipe 80 and the gap GP. Then, the cooling medium CM comes into contact with the inner surface and the outer surface of the metal pipe 80, thereby being able to cool the metal pipe 80. While the cooling medium CM is blown on the metal pipe 80, the metal pipe 80 may be oscillated up and down by using the pin 91. By the above, quenching to the metal pipe 80 after the forming is completed.

Next, the operation and effects of the forming apparatus 10 according to this embodiment will be described.

In the forming apparatus 10 according to this embodiment, the control unit 70 makes the cooling (quenching) of the metal pipe 80 by the cooling medium be performed, by controlling the operation of the blow forming die 13 such that the blow forming die 13 is opened and controlling the cooling unit 90 such that the cooling unit 90 brings the cooling medium into contact with the metal pipe 80, subsequently to the completion of the forming by the blow forming die 13. In this manner, by performing the cooling by the contact with the cooling medium, it is possible to slow down a cooling rate, compared to the cooling by the contact with the blow forming die 13, and thus quenching to enhance the toughness of the metal pipe 80 becomes possible. For example, as shown in FIG. 7A, in a case of performing the cooling by only the contact with the die, the temperature of the metal pipe 80 is rapidly cooled, as shown by the dashed line L1, whereby high strength can be obtained. However, there is a case where sufficient toughness is not obtained. In contrast, by performing die opening after the completion of the forming and then performing the cooling by the cooling medium, it becomes possible to cool the temperature of the metal pipe 80 with a temperature change as shown by the dashed line L2, L3, L4, or L5 of FIG. 7A or the dashed line L10*b* of FIG. 7B, Further, in a case of performing cooling by using the cooling medium, by adjusting a contact time with the cooling medium, the amount of the cooling medium, the temperature of the cooling medium, or the like, it is possible to easily perform adjustment of hardenability, compared to the cooling by contact with the die. By the above, it becomes possible to control the strength and the toughness of a forming product according to a use, and thus it is possible to obtain a forming product having suitable characteristics.

Further, in the forming apparatus 10 according to this embodiment, the control unit 70 makes the cooling of the metal pipe 80 by the blow forming die 13 be performed, by controlling the operation of the blow forming die 13 such that a state where the blow forming die 13 and the metal pipe 80 are brought into contact with each other is maintained for a predetermined time, after the completion of the forming, and makes the cooling of the metal pipe 80 by the cooling medium be performed, after the cooling of the metal pipe 80 by the blow forming die 13. The blow forming die 13 has high thermal conductivity and high heat capacity, and therefore, by bringing the blow forming die 13 into contact with the metal pipe 80, it is possible to rapidly cool the metal pipe 80. In this manner, by increasing the cooling rate by performing the cooling by the blow forming die 13 immediately after the completion of the forming, it is possible to shorten a time after the cooling is started and until the temperature of the metal pipe 80 reaches the martensitic transformation start temperature. As shown in FIG. 7B, a martensite formation possible time of the metal pipe 80 is a time until a predetermined time elapses from the start of the cooling of the metal pipe 80. The shorter the time from the start of the cooling to a time reaching the martensitic transformation start temperature TS, the more the degree of freedom of subsequent cooling increases (it is possible to increase the martensite formation possible time). For example, it is possible to increase the amount of time in which the dashed line L10*b* in FIG. 7B passes through the martensitic transformation area MT. Therefore, it becomes possible to secure a longer martensite formation possible time, and thus it becomes possible to easily adjust the cooling rate by the cooling medium according to desired characteristics. For example, if the martensite formation possible time is long, in a case where it is desired to increase stretchability, performing control of the cooling unit 90 such that the cooling rate becomes lower can be selected, and in a case where it is desired to increase strength, performing control of the cooling unit 90 such that the cooling rate becomes higher can be selected. That is, it is possible to increase the degree of freedom of a quenching condition.

Further, in the forming apparatus 10 according to this embodiment, the control unit 70 makes the cooling of the metal pipe 80 by the blow forming die 13 be performed until the metal pipe 80 reaches the first temperature T1 which is a temperature higher than the martensitic transformation start temperature TS, by controlling the operation of the blow forming die 13. In this way, before the metal pipe 80 reaches the first temperature T1 which is a temperature before the martensitic transformation start temperature TS, it becomes possible to rapidly cool the metal pipe 80 by the blow forming die 13. In this way, it is possible to lengthen the martensite formation possible time.

Further, in the forming apparatus 10 according to this embodiment, the control unit 70 adjusts the hardenability of the metal pipe 80, based on a timing (the starting point P1 of FIG. 7B) when the cooling of the metal pipe 80 by the cooling medium is started. For example, by lengthening the time of low-speed cooling by making the timing of the start of cooling by the cooling medium earlier, it is possible to improve stretchability, and by shortening the time of low-speed cooling by making the timing later, it is possible to improve the strength. In this way, it is possible to easily adjust the hardenability of the metal pipe 80.

Further, in the forming apparatus 10 according to this embodiment, the cooling unit 90 blows gas for cooling as the cooling medium on the metal pipe 80. Due to using gas as the cooling medium, flow rate adjustment or the like is easy, and therefore, it is possible to easily perform adjustment of hardenability. Further, it is possible to cool the metal pipe 80 without contaminating it, compared to a case of using liquid as the cooling medium.

Further, in the forming apparatus 10 according to this embodiment, the cooling unit 90 is configured of the blowing mechanism 60 which is a gas supply unit. In this way, the gas supply unit for expanding the metal pipe 80 can be diverted as the cooling unit, and therefore, it is possible to make the forming apparatus 10 compact.

Further, in the forming apparatus 10 according to this embodiment, the cooling unit 90 may blow gas for cooling on both the inner surface and the outer surface of the metal pipe 80. In this way, it becomes possible to remove scales (oxide layers) (described later) or the like, stuck to both the inner surface and the outer surface of the metal pipe 80, and thus it becomes possible to effectively improve the quality of a forming product.

The forming method according to this embodiment includes: a heating step of heating the metal pipe material 14; a gas supply step of supplying gas into a heated metal pipe material 14, thereby expanding the metal pipe material 14; a forming step of forming the metal pipe 80 by bringing the expanded metal pipe material 14 into contact with the blow forming die 13; and a cooling step of cooling the metal pipe 80 after the forming by a cooling medium. Further, in the cooling step, the cooling of the metal pipe 80 by the cooling medium is performed by opening the blow forming die 13 and bringing the cooling medium into contact with the metal pipe 80, subsequently to the completion of the forming by the blow forming die 13. According to the forming method according to this embodiment, it is possible to obtain the same operation and effects as those of the forming apparatus 10 described above.

The present invention is not limited to the embodiment described above.

Figure 8A:
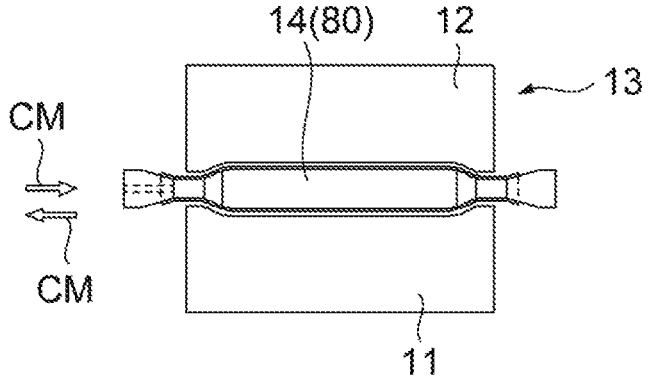
FIGS. 8A to 8C are diagrams showing a cooling process according to a modification example.
Figure 8B:
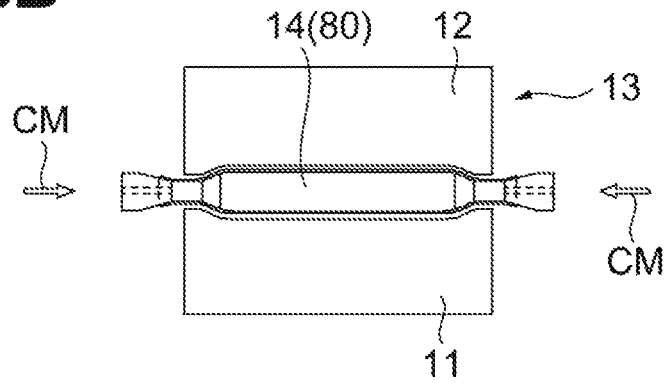
Figure 8C:
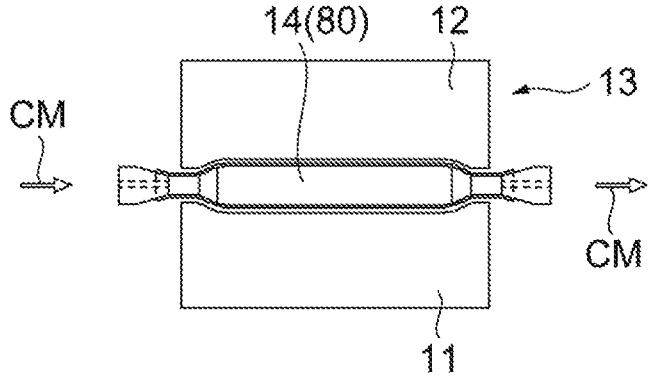

For example, as shown in FIGS. 8A to 8C, cooling may be performed from only the inside of the metal pipe 80 by supplying the cooling medium CM in a state where the blow forming die 13 is opened. In this case, as shown in FIG. 8A, the cooling medium CM may be supplied from one side of the metal pipe 80 and at the same time, be discharged from one side. Further, as shown in FIG. 8B, the cooling medium CM may be supplied from both sides of the metal pipe 80 and discharged from both sides. Further, as shown in FIG. 8C, the cooling medium CM may be supplied from one side of the metal pipe 80 and discharged from the opposite side.

Figure 9A:
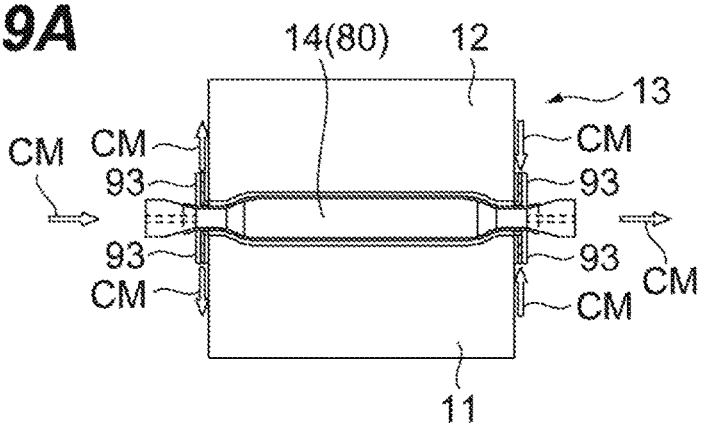
FIGS. 9A to 9D are diagrams showing a cooling process according to a modification example.
Figure 9B:
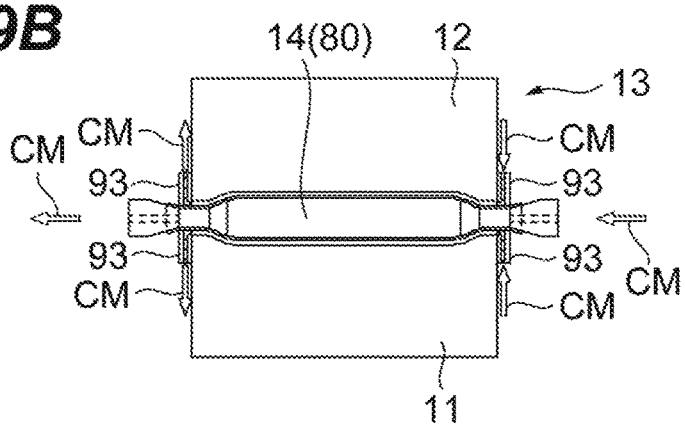
Figure 9C:
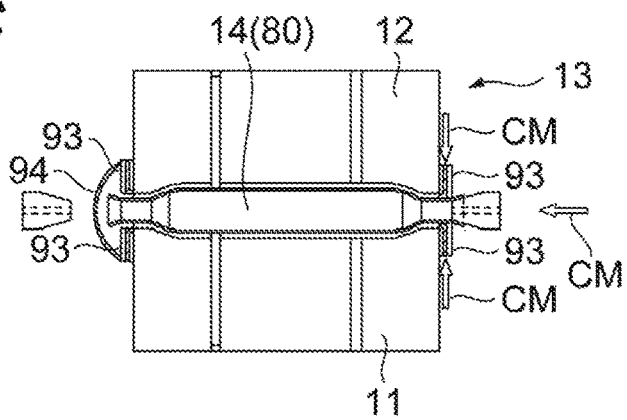
Figure 9D:
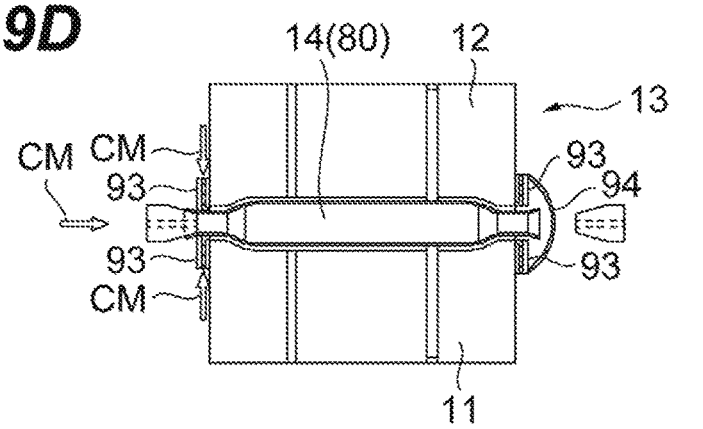

Further, as shown in FIGS. 9A and 9B, in a case of performing cooling from both the inside and the outside of the metal pipe 80, flow paths 93 for supplying the cooling medium CM to the gap between the outer surface of the metal pipe 80 and the surface of the blow forming die 13 may be provided on both sides of the metal pipe 80. Further, as shown in FIG. 9A, a flow direction of the cooling medium CM which cools the inside of the metal pipe 80 and a flow direction of the cooling medium CM which cools the outside may be opposite to each other. Further, as shown in FIGS. 9C and 9D, a structure to blow off scales (oxide layers) inside and outside of the metal pipe 80 may be provided. As shown in FIGS. 9C and 9D, the flow path 93 is made to communicate with the gap outside of the metal pipe 80 at an end portion on the side of supplying the cooling medium CM, out of end portions of the metal pipe 80. On the other hand, at an end portion on the discharge side, the flow path 93 is released, and the cooling medium CM which has passed through the gap outside of the metal pipe 80 comes out as it is. In this state, the cooling medium CM is supplied from the end portion on one side of the metal pipe 80 to the inside and the outside of the metal pipe 80 and discharged along with scales from the end portion on the other side. In this case, in order to prevent the scales from scattering, a scale receiving section 94 which is configured of a net or the like may be provided. In a case where it is not possible to discharge the scale of the cooling medium CM from one direction of the metal pipe 80, switching of a supply direction may be repeated multiple times by switching between the state of FIG. 9C and the state of FIG. 9D.

Figure 10:
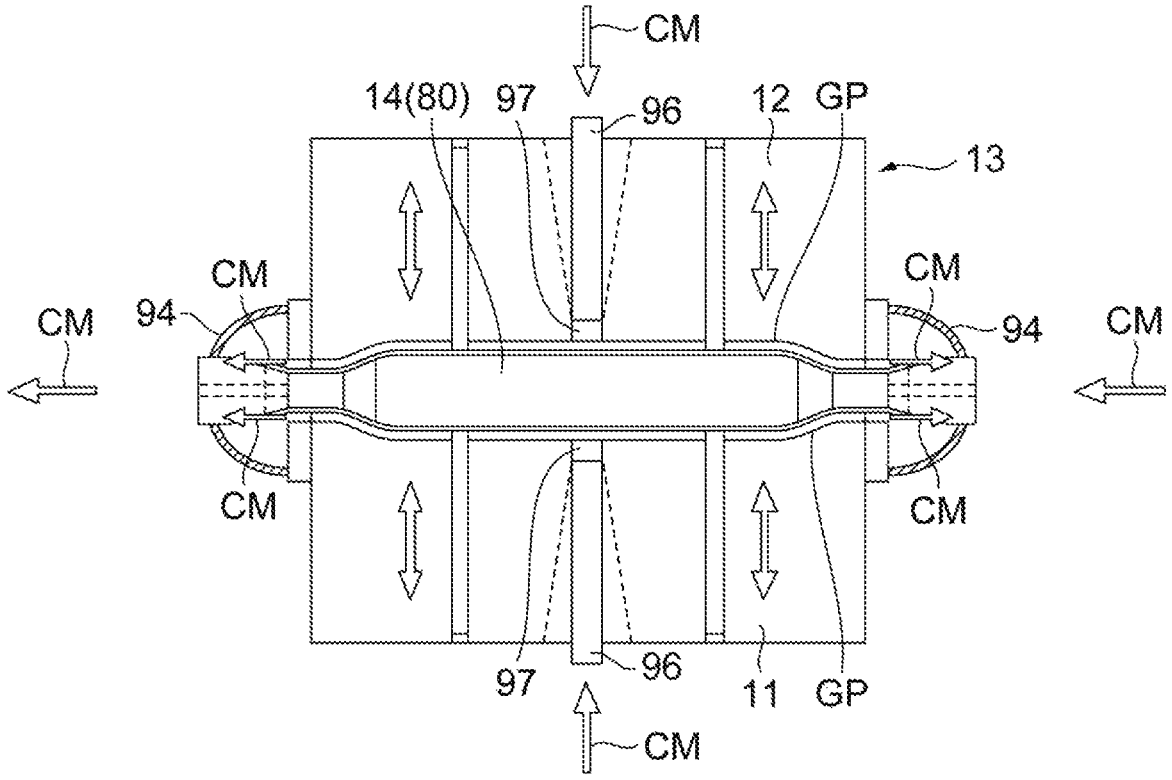
FIG. 10 is a diagram showing a cooling process according to a modification example.

Further, as shown in FIG. 10, a flow path 97 for flowing the cooling medium CM into the interior of the blow forming die 13 may be provided. The flow path 97 is provided at approximately the center in a length direction of each of the lower die 11 and the upper die 12. Due to this configuration, the cooling medium CM is supplied to the gap GP outside of the metal pipe 80 through the flow path 97 in the blow forming die 13 and discharged from the sides of both ends of the metal pipe 80. Further, at the time of forming, the flow path 97 is sealed by a pin 96, and a forming surface is secured by the tip face of the pin 96.

Figure 11A:
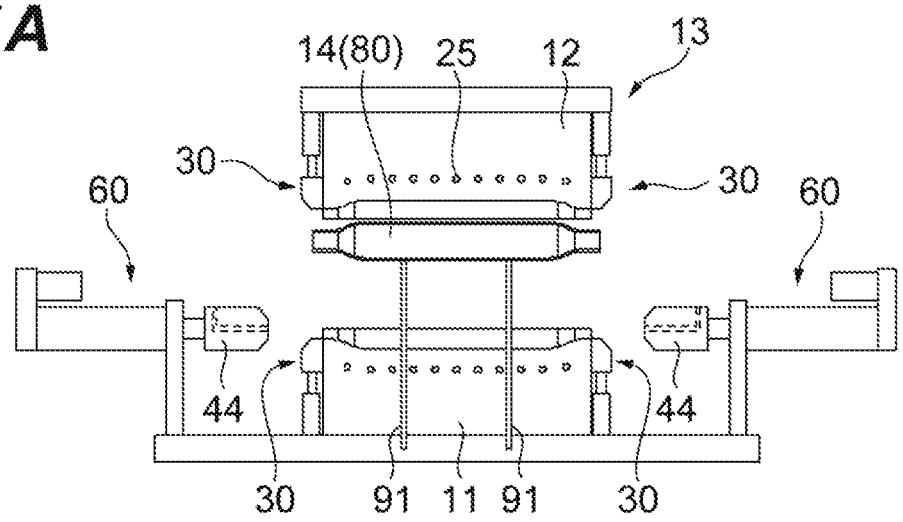
FIGS. 11A to 11C are diagrams showing a cooling process according to a modification example.
Figure 11B:
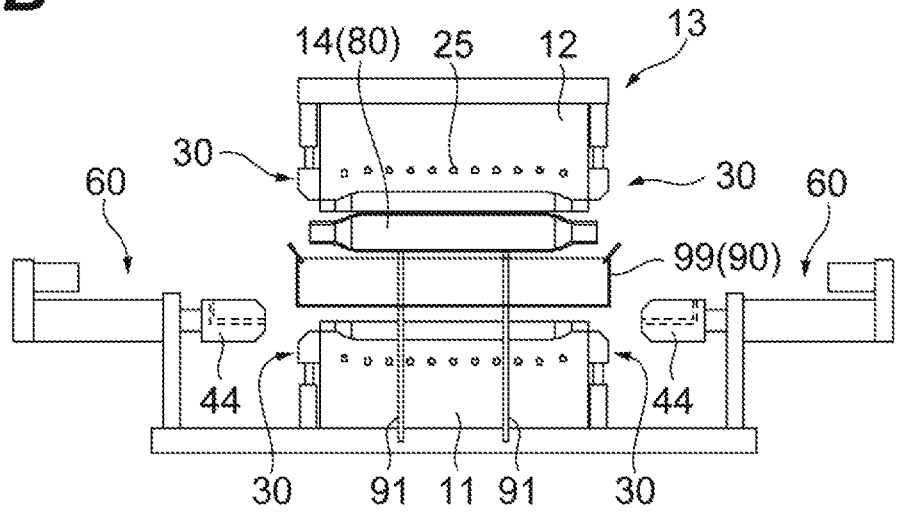
Figure 11C:
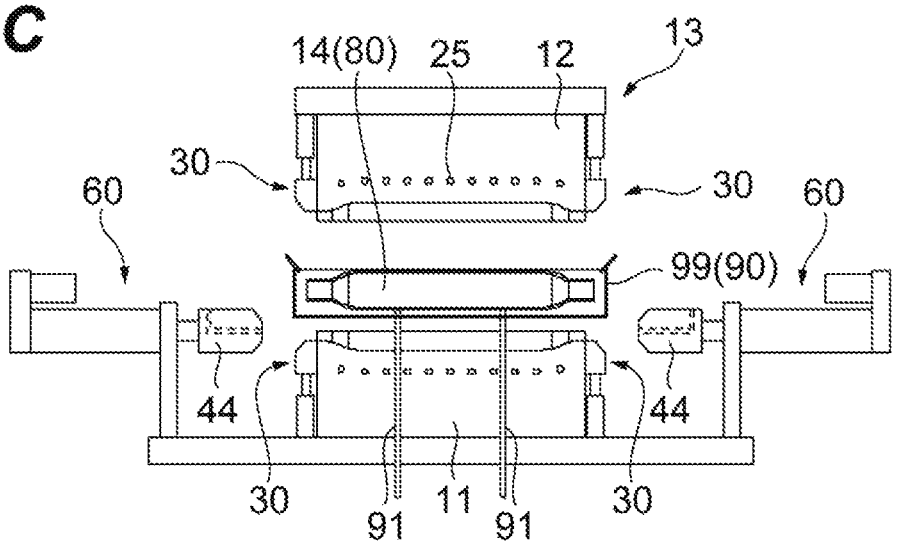
Figure 12A:
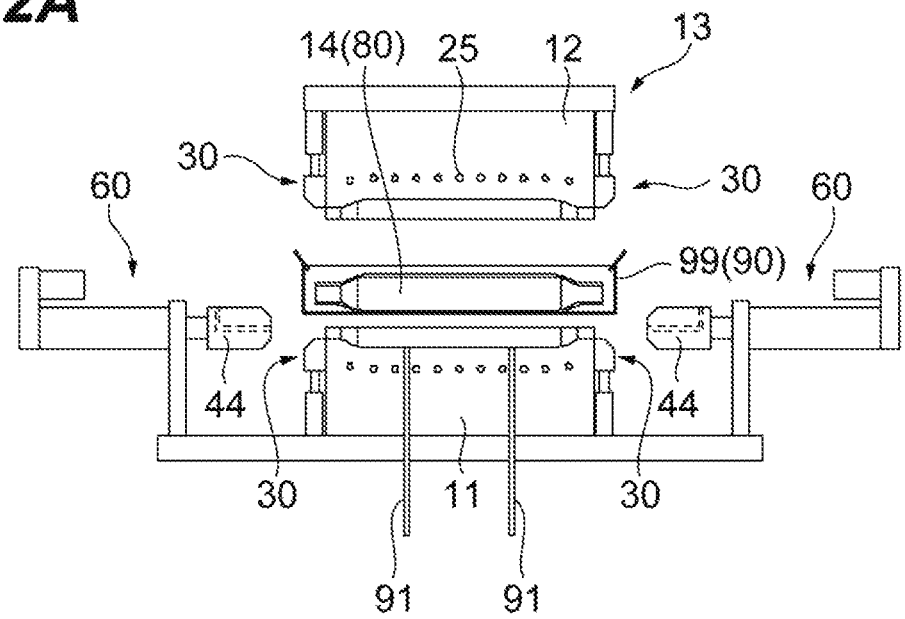
FIGS. 12A and 12B are diagrams showing a cooling process according to a modification example.
Figure 12B:
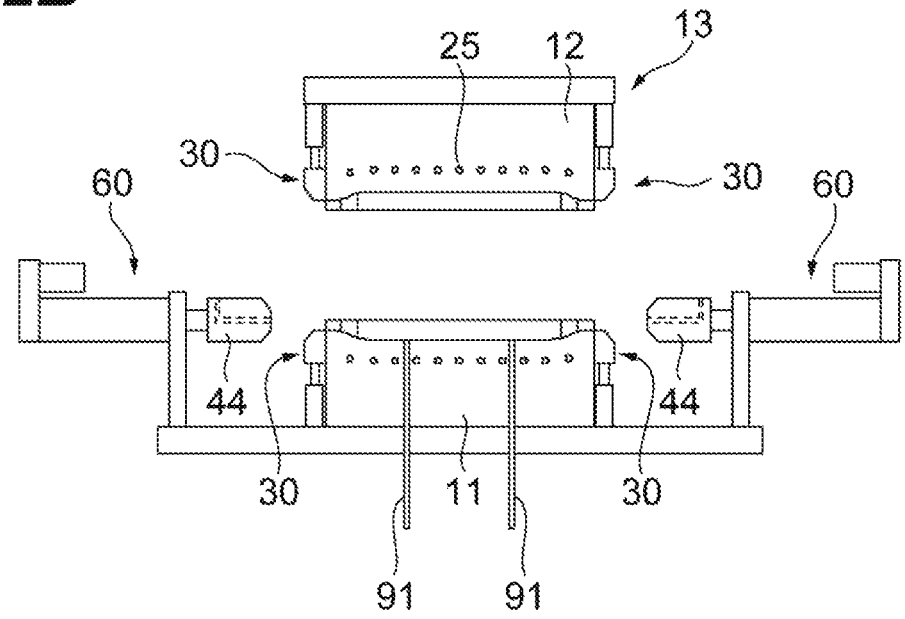

Further, as shown in FIGS. 11A to 11C, 12A, and 12B, as the cooling unit 90, a cooling box 99 may be applied. The cooling box 99 is used for cooling of the metal pipe 80 and extraction thereof. In this case, as shown in FIG. 11A, after the cooling by the blow forming die 13, or after the completion of the forming, the blow forming die 13 is opened and the metal pipe 80 is pushed up by the pins 91. Next, as shown in FIG. 11B, the cooling box 99 is disposed in the blow forming die 13. Next, as shown in FIG. 11C, the metal pipe 80 is accommodated in the cooling box 99 and cooling of the metal pipe 80 is then performed by a cooling medium such as liquid or solid. Next, as shown in FIG. 12A, the pins 91 are lowered, and as shown in FIG. 12B, the metal pipe 80 is removed along with the cooling box 99 from the blow forming die 13.

Figure 13A:
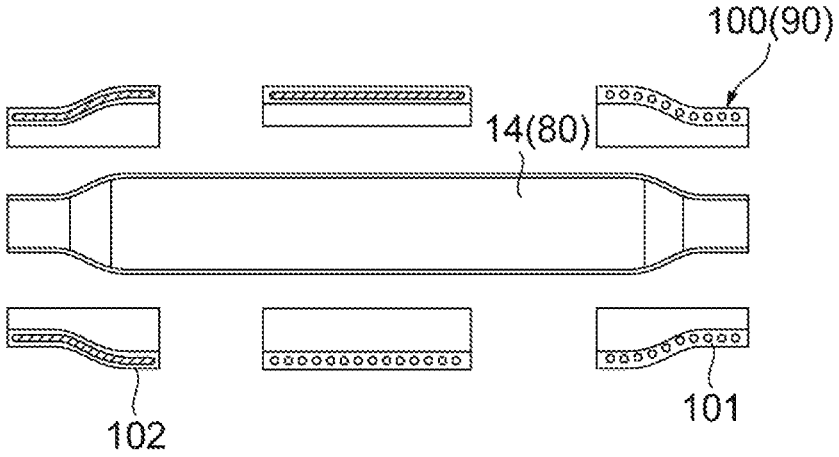
FIGS. 13A and 13B are diagrams showing a cooling process according to a modification example.
Figure 13B:
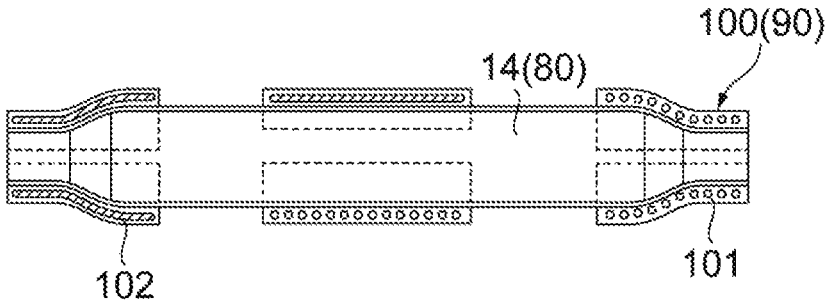

Further, as shown in FIGS. 13A and 13B, as the cooling unit 90, a pinching jig 100 may be applied. The pinching jig 100 is divided into a plurality of pieces each having a shape along the outer surface of the metal pipe 80. In the example shown in FIGS. 13A and 13B, the pinching jig 100 has pieces pinching both end portions of the metal pipe 80 and a piece pinching the vicinity of a central portion. Some pieces of the pinching jig 100 have flow paths 101 for flowing a cooling medium such as cooling water inside thereof, and some pieces have heating units 102 such as sheathed heaters. However, heating may be performed by making a heating medium such as hot water flow through the flow paths 101. In a case of using the pinching jig 100, after the blow forming die 13 is opened (for example, steps corresponding to FIGS. 11B and 11C), the pinching jig 100 is mounted on the metal pipe 80. In this way, as shown in FIG. 13B, a state where the pinching jig 100 is mounted on the metal pipe 80 is created. In this state, the metal pipe 80 is cooled by making a cooling medium flow through the flow paths 101. Further, with respect to a portion in which it is desired to be slowly cooled, it may be partially heated by the heating unit 102. If the cooling by the pinching jig 100 is completed, the metal pipe 80 is removed along with the pinching jig 100 from, the blow forming die 13.

Figure 14A:
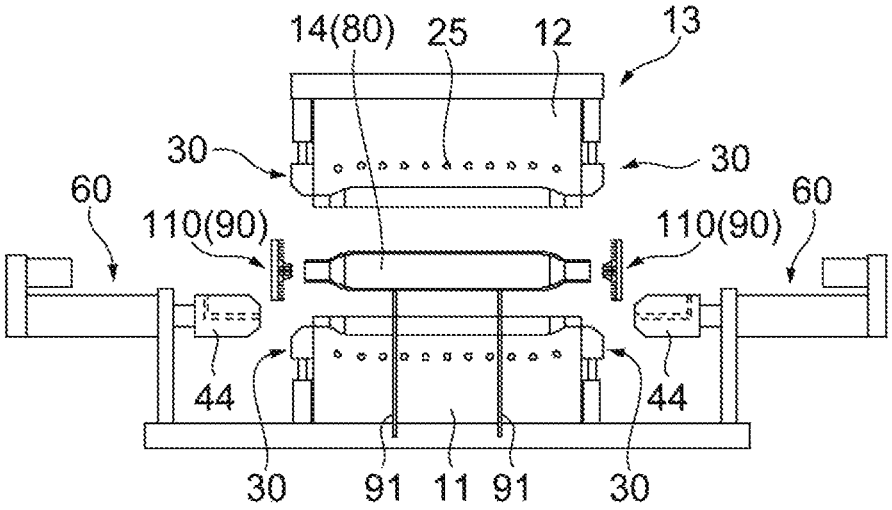
FIGS. 14A and 14B are diagrams showing a cooling process according to a modification example.
Figure 14B:
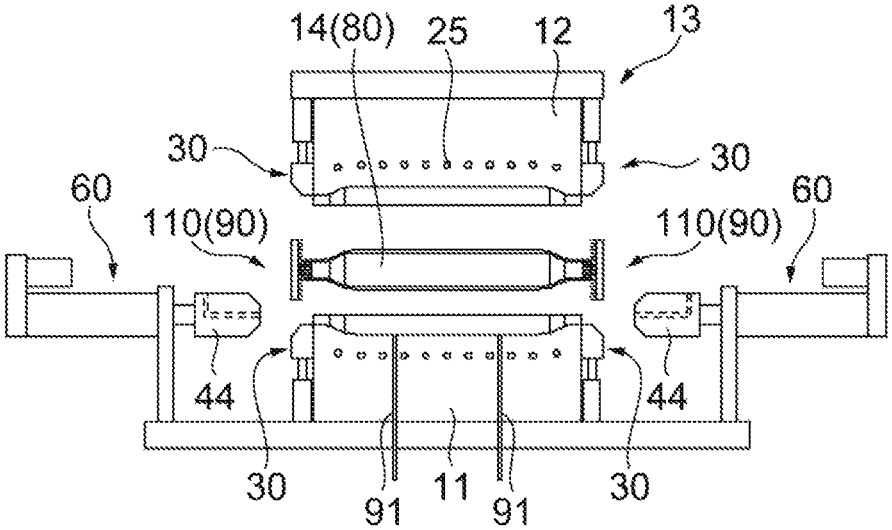

Further, as shown in FIGS. 14A and 14B, as the cooling unit 90, an extraction chuck 110 having an air blow function may be applied. The extraction chucks 110 can be mounted on both end portions of the metal pipe 80, and it is possible to blow compressed air as a cooling medium on the inside and the outside of the metal pipe 80 in a state where the extraction chucks 110 are mounted. In a case of using the extraction chuck 110, after the blow forming die 13 is opened (for example, steps corresponding to FIGS. 11B and 11C), the extraction chucks 110 are mounted on the metal pipe 80. In this way, as shown in FIG. 14B, a state where the extraction chucks 110 are mounted on the metal pipe 80 is created. In this state, the metal pipe 80 is cooled by performing air blow. If the cooling by the air blow is completed, the metal pipe 80 is removed along with the extraction chucks 110 from the blow forming die 13.

Figure 15A:
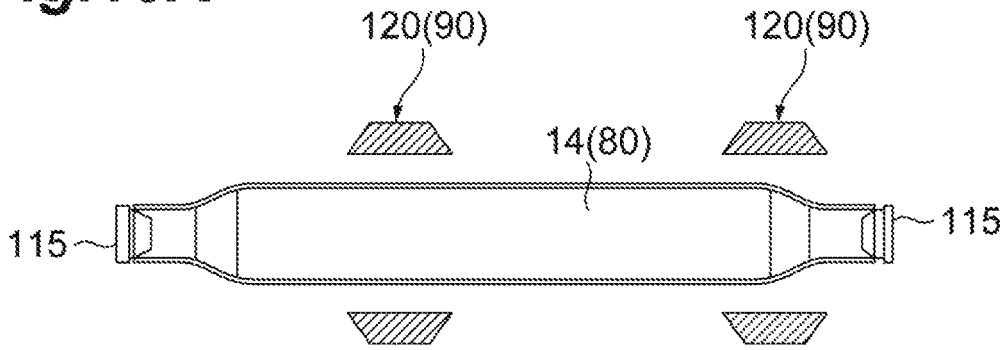
FIGS. 15A and 15B are diagrams showing a cooling process according to a modification example.
Figure 15B:
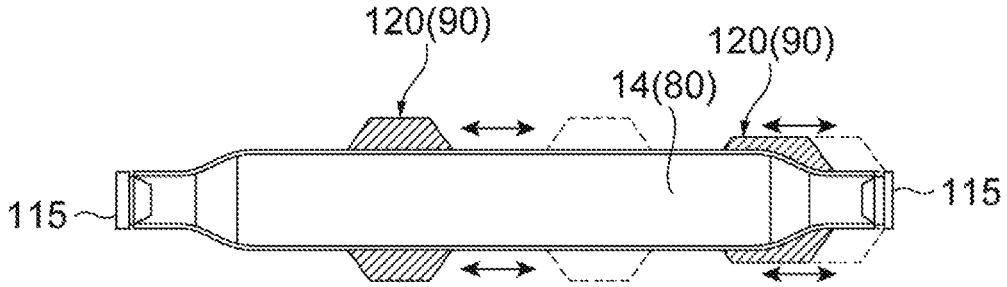

Further, as shown in FIGS. 15A and 15B, as the cooling unit 90, a chuck 120 having a wiping function may be applied. The chuck 120 can be mounted on the outer surface of the metal pipe 80. The outer surface of the metal pipe 80 can be wiped by the chuck 120 by driving the chuck 120 along the outer surface of the metal pipe 80 in a state where the chuck 120 is mounted thereon. In a case of using the chuck 120, after the metal pipe 80 is removed from the blow forming die 13 (for example, a step corresponding to FIG. 12B), the chuck 120 is mounted on the metal pipe 80. In this way, as shown in FIG. 15B, a state where the chuck 120 is mounted on the metal pipe 80 is created. In this state, the metal pipe 80 is cooled by wiping the surface of the metal pipe 80 by the chuck 120. In a case of using the chuck 120, only a place which requires cooling may be wiped, and the whole may be slowly wiped thoroughly. Alternatively, only a place which requires cooling is pinched by the chuck 120 and wiping may not be performed.

Figure 16A:
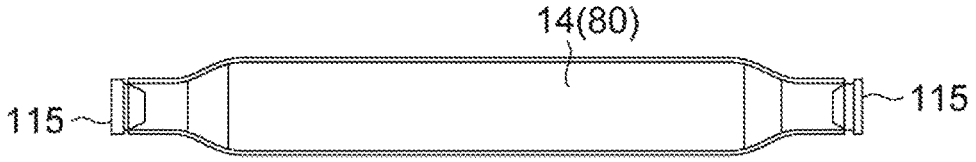
FIGS. 16A and 16B are diagrams showing a cooling process according to a modification example.
Figure 16B:
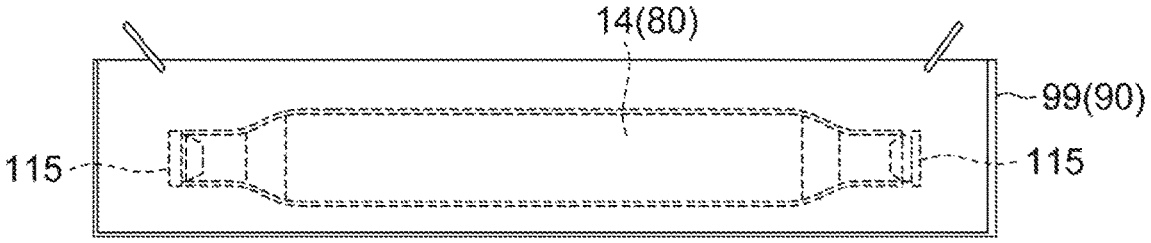

Further, as shown in FIGS. 16A and 16B, as the cooling unit 90, the cooling box 99 disposed outside the blow forming die 13 may be applied. In this case, when the metal pipe 80 is removed from the blow forming die 13, extraction chucks 115 are mounted on the metal pipe 80, as shown in FIG. 16A. Thereafter, after the metal pipe 80 is removed from the blow forming die 13 (for example, a step corresponding to FIG. 12B), the metal pipe 80 is accommodated in the cooling box 99. The cooling box 99 has been filled with a cooling medium such as liquid or solid (dry ice or the like).

Further, the forming apparatus 10 described above is provided with the heating mechanism 50 capable of performing heating treatment between the upper and lower dies, and the heating mechanism 50 heats the metal pipe material 14 by using Joule heat by energization. However, there is no limitation thereto. For example, a configuration is also acceptable in which heating treatment is performed at a place other than the place between the upper and lower dies and a metallic pipe after the heating is transported into an area between the dies. Further, in addition to the use of Joule heat by energization, radiation heat of a heater or the like may be used, and it is also possible to perform heating by using a high-frequency induction current.

As the high-pressure gas, a non-oxidizing gas or an inert gas such as nitrogen gas or argon gas can be adopted mainly. However, although these gases can make generation of an oxidized scale in a metal pipe difficult, these gases are expensive. In this regard, in the case of compressed air, as long as a major problem due to the generation of an oxidized scale is not caused, it is inexpensive, and even if it leaks into the atmosphere, there is no actual harm, and handling is very easy. Therefore, it is possible to smoothly carry out a blowing process.

The blow forming die may be either of a non-water-cooled die or a water-cooled die. However, the non-water-cooled die needs a long time when reducing the temperature of the die to a temperature near an ordinary temperature after the end of blow forming. In this regard, in the case of the water-cooled die, cooling is completed in a short time. Therefore, from the viewpoint of improvement in productivity, the water-cooled die is preferable.

Further, in the forming apparatus 10 described above, the cooling of the metal pipe 80 by the blow forming die 13 is performed until the metal pipe 80 reaches the first temperature (the temperature T1 in FIG. 7B) which is a temperature higher than the martensitic transformation start temperature TS, and thereafter, the die opening of the blow forming die 13 is performed, thereby releasing the contact between the blow forming die 13 and the metal pipe 80, and the cooling of the metal pipe 80 by the cooling medium is started. However, control other than this control may be adopted. For example, a configuration may be made in which the cooling of the metal pipe 80 by the blow forming die 13 is performed until the temperature of the metal pipe 80 becomes a temperature lower than the martensitic transformation start temperature TS, and thereafter, the die opening of the blow forming die 13 is performed, thereby releasing the contact between the blow forming die 13 and the metal pipe 80, and the cooling of the metal pipe 80 by the cooling medium is started. That is, quenching by the blow forming die 13 and quenching by the cooling medium may be used in combination in the martensitic transformation area MT shown in FIGS. 7A and 7B.

The forming apparatus and the forming method according to embodiments of the present invention can be used as a forming apparatus and a forming method, in which strength and toughness are controlled according to, for example, a use, and thus a forming product having suitable characteristics is provided.

It should be understood that the invention is not limited to the above-described embodiment, but may be modified into various forms on the basis of the spirit of the invention. Additionally, the modifications are included in the scope of the invention.

What is claimed is:

1. A forming apparatus configured to form a metal pipe, comprising:

a heating unit configured to heat a metal pipe material;

a gas supply unit configured to supply gas into a heated metal pipe material, thereby expanding so as to expand the metal pipe material;

a die configured to form the metal pipe through contact with the expanded metal pipe material;

a cooling unit configured to cool the metal pipe by a cooling medium; and a control unit configured to control the die, the gas supply unit, and the cooling unit, wherein the control unit is configured to:

control the die such that a state where the die in contact with the metal pipe is maintained for a predetermined time such that the die cools the metal pipe;

control the die to separate the die from the metal pipe after cooling the metal pipe by the die; and control the cooling unit to supply the metal pipe with the cooling medium after separating the metal pipe from the die.

2. The forming apparatus according to claim 1, wherein the state is maintained until the metal pipe reaches a first temperature that is a temperature higher than a martensitic transformation start temperature.

3. The forming apparatus according to claim 1, wherein the control unit is configured to adjust hardenability of the metal pipe, based on a timing when cooling of the metal pipe by the cooling medium is started.

4. The forming apparatus according to claim 1, wherein the cooling unit is configured to blow gas for cooling as the cooling medium on the metal pipe.

5. The forming apparatus according to claim 4, wherein the cooling unit is included in the gas supply unit.

6. The forming apparatus according to claim 4, wherein the cooling unit is configured to blow the gas for cooling on both the inner surface and the outer surface of the metal pipe.

7. The forming apparatus according to claim 1, further comprising a supporter configured to support the metal pipe, wherein the control unit is configured to control the supporter so as to support the metal pipe when supplying the metal pipe with the cooling medium.

8. The forming apparatus according to claim 7, wherein the supporter is configured to support the metal pipe in the opened die.

9. The forming apparatus according to claim 7, wherein the supporter is configured to oscillate the metal pipe up and down when supplying the metal pipe with the cooling medium.

10. The forming apparatus according to claim 7, wherein the metal pipe is separated from the gas supply unit when the supporter supports the metal pipe.

11. The forming apparatus according to claim 6, further comprising a scale receiver configured to prevent scales negated from the metal pipe from scattering.

12. The forming apparatus according to claim 1, wherein the die includes an upper die and a lower die, and wherein at least one of the upper die and the lower die has a flow path which is connected to the cooling unit and is configured to flow the cooling medium in to the die.

13. The forming apparatus according to claim 12, wherein the die includes a sealant configured to seal the flow path.

14. The forming apparatus according to claim 1, wherein the cooling unit includes a cooling box in which the cooling medium is contained.

15. The forming apparatus according to claim 4, wherein the cooling unit includes extraction chucks configured to support the metal pipe and blow the gas for cooling, and wherein the metal pipe is separated from the die and the gas supply unit when the extraction chucks supports the metal pipe.

* * * * *